US010238176B2

(12) United States Patent
Bruce et al.

(10) Patent No.: US 10,238,176 B2
(45) Date of Patent: Mar. 26, 2019

(54) BRAIDING MACHINE AND METHOD OF FORMING A BRAIDED ARTICLE USING SUCH BRAIDING MACHINE

(71) Applicant: NIKE, Inc., Beaverton, OR (US)

(72) Inventors: Robert M. Bruce, Portland, OR (US); Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 571 days.

(21) Appl. No.: 14/721,563

(22) Filed: May 26, 2015

(65) Prior Publication Data

US 2016/0345676 A1 Dec. 1, 2016

(51) Int. Cl.

| | |
|---|---|
| ***A43B 23/02*** | (2006.01) |
| ***D04C 1/06*** | (2006.01) |
| ***A43B 23/04*** | (2006.01) |
| ***D04C 3/48*** | (2006.01) |
| ***D04C 1/10*** | (2006.01) |
| ***D04C 3/28*** | (2006.01) |

(52) U.S. Cl.

CPC ..... *A43B 23/0245* (2013.01); *A43B 23/042* (2013.01); *D04C 1/06* (2013.01); *D04C 1/10* (2013.01); *D04C 3/28* (2013.01); *D04C 3/48* (2013.01); *D10B 2501/043* (2013.01)

(58) Field of Classification Search

CPC ..... D04C 3/24; D04C 3/30; D04C 3/48

See application file for complete search history.

(56) References Cited

U.S. PATENT DOCUMENTS

| | | | |
|---|---|---|---|
| 165,941 | A | 7/1875 | Malhere |
| 293,020 | A | 1/1884 | Hedtmann |
| 329,739 | A | 11/1885 | Henkels |
| 376,372 | A | 1/1888 | Dodge et al. |
| 450,685 | A | 4/1891 | Struss |
| 847,005 | A | 3/1907 | Kirberg et al. |
| 494,022 | A | 7/1908 | Lepperhoff et al. |
| 810,056 | A | 1/1909 | Janssen et al. |

(Continued)

FOREIGN PATENT DOCUMENTS

| | | | |
|---|---|---|---|
| CN | 1090897 | A | 8/1994 |
| CN | 2532562 | Y | 1/2003 |

(Continued)

OTHER PUBLICATIONS

Branscomb D., et al., "New Directions in Braiding," Journal of Engineered Fibers and Fabrics, 2013, vol. 8 (2), pp. 11-24.

(Continued)

*Primary Examiner* — Shaun R Hurley

(74) *Attorney, Agent, or Firm* — Shook, Hardy and Bacon LLP

(57) ABSTRACT

Aspects herein are directed to a braiding machine and method of forming a braided upper for an article of footwear. The braiding machine includes a support structure that includes a track defining a plane with a plurality of rotor metals arranged along the track. The method of forming an article of footwear includes extending a plurality of threads through a ring located along a plane at a braiding point of the braiding machine, and braiding over a forming mandrel that passes from a first side of the braiding point to a second side of the braiding point. The braiding machine being capable of forming intricate braided structures.

28 Claims, 31 Drawing Sheets

(56) References Cited

U.S. PATENT DOCUMENTS 920,994 A 5/1909 Otto et al.
936,356 A 10/1909 Rahm et al.
979,502 A 12/1910 Janssen et al.
1,117,330 A 11/1914 Cobb et al.
1,318,888 A 10/1919 Carpentier
1,379,478 A 5/1921 Schevitz et al.
1,527,344 A 2/1925 Bente et al.
1,538,160 A 5/1925 Bosebeck
1,554,325 A 9/1925 Bente
1,583,273 A 5/1926 Bosebeck
1,593,670 A 7/1926 Petersen et al.
1,622,021 A 3/1927 Birkin et al.
1,637,716 A 8/1927 Turck
1,885,676 A 11/1932 Blaisdell
1,887,643 A 11/1932 Huber
2,022,350 A 11/1935 Huber
2,067,333 A 1/1937 Olson
2,091,215 A 8/1937 Price
2,188,640 A 1/1940 Bloch et al.
2,334,399 A 11/1943 Fether
2,788,700 A 4/1957 Crossley et al.
2,879,687 A 3/1959 Leimbach et al.
2,936,670 A 5/1960 Walter et al.
2,941,440 A 6/1960 Scanlon et al.
2,960,905 A 11/1960 Scanlon et al.
3,282,757 A 11/1966 Brussee
3,397,847 A 8/1968 Thaden
3,426,804 A 2/1969 Bluck
3,521,315 A 7/1970 Chatzimikes
3,541,247 A 11/1970 Moi et al.
3,586,058 A 6/1971 Ahrens et al.
3,714,862 A 2/1973 Berger
3,899,206 A 8/1975 Miura
3,943,361 A 3/1976 Miller
4,005,873 A 2/1977 Jacobsen et al.
4,275,638 A 6/1981 DeYoung
4,312,261 A 1/1982 Florentine et al.
4,323,925 A 4/1982 Abell et al.
4,351,889 A 9/1982 Sundberg et al.
4,366,476 A 12/1982 Hickin
4,494,436 A 1/1985 Kruesi
4,519,290 A 5/1985 Inman et al.
4,591,155 A 5/1986 Adachi
4,615,256 A 10/1986 Fukuta et al.
4,719,837 A 1/1988 McConnell et al.
4,847,063 A 6/1989 Smith
4,848,745 A 7/1989 Bohannan et al.
4,857,124 A 8/1989 Shobert et al.
4,884,309 A 12/1989 Shafir et al.
4,885,973 A 12/1989 Spain
4,909,127 A 3/1990 Skelton et al.
4,916,997 A 4/1990 Spain
4,934,240 A 6/1990 Culp et al.
4,976,812 A 12/1990 McConnell et al.
4,992,313 A 2/1991 Shobert et al.
5,001,961 A 3/1991 Spain
5,067,525 A 11/1991 Tsuzuki et al.
5,121,329 A 6/1992 Crump et al.
5,195,030 A 3/1993 White
5,203,249 A 4/1993 Adams et al.
5,257,571 A 11/1993 Richardson et al.
5,287,790 A 2/1994 Akiyama et al.
5,348,056 A 9/1994 Tsuzuki
5,361,674 A 11/1994 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,601,522 A 2/1997 Piramoon et al.
5,879,725 A 3/1999 Potter
5,885,622 A 3/1999 Daley et al.
5,915,030 A 6/1999 Viebach et al.
6,024,005 A 2/2000 Uozumi
6,029,375 A 2/2000 Borel et al.
6,029,376 A 2/2000 Cass et al.
6,345,598 B1 2/2002 Bogdanovich et al.
6,495,227 B1 12/2002 Cahuzac
6,510,961 B1 1/2003 Head et al.
6,679,152 B1 1/2004 Head et al.
6,696,001 B1 2/2004 Quddus
6,741,728 B1 5/2004 Genest
7,004,967 B2 2/2006 Chouinard et al.
7,069,935 B2 7/2006 Bousfield et al.
7,079,916 B2 7/2006 Stimpson
7,093,527 B2 8/2006 Rapaport et al.
7,204,903 B2 4/2007 Yasui
7,252,028 B2 8/2007 Bechtold et al.
7,262,353 B2 8/2007 Bartholomew et al.
7,300,014 B2 11/2007 Allen
7,347,011 B2 3/2008 Dua et al.
7,444,916 B2 11/2008 Hirukawa
7,566,376 B2 7/2009 Matsuoka
7,661,170 B2 2/2010 Goode et al.
7,793,576 B2 9/2010 Head et al.
7,815,141 B2 10/2010 Uozumi et al.
7,908,956 B2 3/2011 Dow et al.
7,938,853 B2 5/2011 Chouinard et al.
8,006,601 B2 8/2011 Inazawa et al.
8,061,253 B2 11/2011 Wybrow
8,192,572 B2 6/2012 Willey et al.
8,210,086 B2 7/2012 Head et al.
8,261,648 B1 9/2012 Marchand et al.
8,266,827 B2 9/2012 Dojan et al.
8,347,772 B2 1/2013 Dow et al.
8,394,222 B2 3/2013 Rettig
8,511,214 B2 8/2013 Gries
8,578,534 B2 11/2013 Langvin et al.
8,651,007 B2 2/2014 Adams
8,690,962 B2 4/2014 Dignam et al.
8,757,038 B2 6/2014 Siegismund
8,770,081 B2 7/2014 David et al.
8,789,452 B1 7/2014 Janardhan et al.
8,794,118 B2 8/2014 Dow et al.
9,144,284 B2 9/2015 Chung et al.
9,181,642 B2 11/2015 Cahuzac
9,788,603 B2 10/2017 Jarvis
2001/0026740 A1 10/2001 Yamanishi
2002/0160068 A1 10/2002 Nakamura
2004/0200014 A1 10/2004 Pons
2004/0237760 A1 12/2004 Shimizu
2005/0039769 A1 2/2005 Bousfield et al.
2005/0178026 A1 8/2005 Friton
2006/0052892 A1 3/2006 Matsushima et al.
2006/0061613 A1 3/2006 Fienup et al.
2008/0189194 A1 8/2008 Bentvelzen
2009/0193961 A1 8/2009 Jensen et al.
2009/0306762 A1 12/2009 McCullagh et al.
2010/0077634 A1 4/2010 Bell
2010/0095556 A1 4/2010 Jarvis
2010/0154256 A1 6/2010 Dua
2011/0005371 A1 1/2011 Giebels et al.
2011/0203446 A1* 8/2011 Dow ..... D04C 1/06 87/11
2011/0232008 A1 9/2011 Crisp
2012/0117822 A1 5/2012 Jarvis
2012/0233882 A1 9/2012 Huffa et al.
2013/0167710 A1* 7/2013 Dow ..... D04C 1/06 87/9
2013/0239790 A1 9/2013 Thompson et al.
2013/0258085 A1 10/2013 Leedy et al.
2013/0269159 A1 10/2013 Robitaille et al.
2013/0304232 A1 11/2013 Gries
2013/0305465 A1 11/2013 Siegismund
2013/0305911 A1 11/2013 Masson et al.
2014/0013931 A1 1/2014 Dow et al.
2014/0088688 A1 3/2014 Lilburn et al.
2014/0137434 A1 5/2014 Craig
2014/0182170 A1 7/2014 Wawrousek et al.
2014/0182447 A1 7/2014 Kang et al.
2014/0230634 A1 8/2014 Nakai
2014/0283671 A1 9/2014 Head et al.
2014/0373389 A1 12/2014 Bruce
2014/0377488 A1 12/2014 Jamison

(56) References Cited

U.S. PATENT DOCUMENTS

| | | | | |
|---|---|---|---|---|
| 2015/0007451 | A1 | 1/2015 | Bruce | |
| 2015/0033933 | A1 | 2/2015 | Kobayashi | |
| 2015/0045831 | A1 | 2/2015 | Allen | |
| 2015/0101134 | A1 | 4/2015 | Manz et al. | |
| 2015/0299916 | A1 | 10/2015 | Reinisch | |
| 2016/0076178 | A1 | 3/2016 | Head et al. | |
| 2016/0158769 | A1 | 6/2016 | Hornek et al. | |
| 2016/0251786 | A1* | 9/2016 | Ichikawa | D04C 3/18 87/55 |
| 2016/0289873 | A1 | 10/2016 | Head | |
| 2016/0345677 | A1* | 12/2016 | Bruce | A43B 23/0245 |
| 2017/0037548 | A1 | 2/2017 | Lee | |

FOREIGN PATENT DOCUMENTS

| | | | |
|---|---|---|---|
| CN | 201883267 | U | 6/2011 |
| DE | 726634 | C | 10/1942 |
| DE | 2162170 | A1 | 6/1973 |
| DE | 3843488 | A1 | 7/1990 |
| DE | 4306286 | A1 | 9/1993 |
| EP | 1486601 | A1 | 12/2004 |
| EP | 2657384 | A1 | 10/2013 |
| GB | 191423221 | A | 11/1915 |
| GB | 161552 | | 12/1921 |
| GB | 477556 | A | 1/1938 |
| GB | 1196983 | | 7/1970 |
| JP | H04174749 | A | 6/1992 |
| JP | H0995844 | A | 4/1997 |
| JP | 10158965 | A | 6/1998 |
| JP | 11350317 | A | 12/1999 |
| JP | 2004305449 | | 11/2004 |
| JP | 2008240187 | A | 10/2008 |
| JP | 2013147760 | A | 8/2013 |
| KR | 20020038168 | A | 5/2002 |
| TW | M305221 | U | 1/2007 |
| TW | M447894 | U | 3/2013 |
| TW | 201328624 | A | 7/2013 |
| TW | M473088 | U | 3/2014 |
| TW | M487651 | U | 10/2014 |
| WO | 0153583 | A1 | 7/2001 |
| WO | 2008052947 | A1 | 5/2008 |
| WO | 2009000371 | A1 | 12/2008 |
| WO | 2011103272 | A2 | 8/2011 |
| WO | 2011111564 | A1 | 9/2011 |
| WO | 2014137825 | A1 | 9/2014 |

OTHER PUBLICATIONS

International Search Report and Written Opinion dated Sep. 27, 2016 for International Patent Application No. PCT/US2016/034097, 13 pages.

Anonymous: "3D print shoe last", styleforum, Feb. 19, 2014 (Feb. 19, 2014), pp. 1-4, XP055241611, Retrieved from the Internet on Jan. 14, 2016: URL:http://www.styleforum.net/t/137783/3dprint-shoe-last.

Ricardo Bilton: "How 3D body scanning will help you find a suit that actually fits", May 2, 2013 (May 2, 2013), XP055241783, URL: http://venturebeat.com/2013/05/02/how-3d-body-scanning-will-help-you-find-a-suit-that-actually-fits/, Retrieved on Jan. 15, 2016.

International Search Report and Written Opinion dated Jan. 27, 2016 in International Patent Application No. PCT/US2015/055884, 14 pages.

International Search Report and Written Opinion dated Jan. 19, 2016 in International Patent Application No. PCT/US2015/055625.

International Search Report and Written Opinion dated Nov. 11, 2016 in International Patent Application No. PCT/US2016/034102, 19 pages.

International Search Report and Written Opinion dated Nov. 14, 2016 in International Patent Application No. PCT/US2016/034104, 19 pages.

International Search Report and Written Opinion dated Nov. 17, 2016 in International Patent Application No. PCT/US2016/045319, 13 pages.

Non-Final Office Action dated Jun. 1, 2017 in U.S. Appl. No. 14/821,125, 21 pages.

Notice of Allowance dated Jun. 21, 2017 in U.S. Appl. No. 14/565,682, 7 pages.

Non-Final Office Action dated Oct. 6, 2017 in U.S. Appl. No. 14/721,314, 8 pages.

Notice of Allowance dated Nov. 2, 2017 in U.S. Appl. No. 14/821,125, 7 pages.

International Preliminary Report on Patentability dated Dec. 7, 2017 in International Patent Application No. PCTUS2016034102, 13 pages.

International Preliminary Report on Patentability dated Dec. 7, 2017 in International Patent Application No. PCTUS2016034104, 13 pages.

International Preliminary Report on Patentability dated Dec. 7, 2017 in International Patent Application No. PCTUS2016034097, 9 pages.

International Preliminary Report on Patentability dated Jun. 22, 2017 in International Patent Application No. PCT/US2015/055625,5 pages.

International Preliminary Report on Patentability dated Jun. 22, 2017 in International Patent Application No. PCT/US2015/055884,4 pages.

Non-Final Office Action dated Aug. 23, 2017 in U.S. Appl. No. 14/565,582, 9 pages.

Non-Final Office Action dated Sep. 14, 2017 in U.S. Appl. No. 14/820,822, 14 pages.

Notice of Allowance dated Sep. 19, 2017 in U.S. Appl. No. 14/565,682, 7 pages.

Non-Final Office Action dated Feb. 22, 2018 in U.S. Appl. No. 14/721,614, 9 pages.

Final Office Action dated Feb. 28, 2028 in U.S. Appl. No. 14/565,582, 9 pages.

Notice of Allowance dated Apr. 25, 2018 in U.S Appl. No. 14/721,314, 6 pages.

Office Action dated Feb. 16, 2018 in Australian Patent Application No. 2015361192, 3 pages.

International Preliminary Report on Patentability dated Feb. 22, 2018 in International Patent Application No. PCTUS2016045319, 9 pages.

Non-Final Office Action dated Jul. 19, 2018 in U.S. Appl. No. 14/565,582, 12 pages.

Final Office Action dated Sep. 12, 2018 in U.S. Appl. No. 14/721,614, 11 pages.

* cited by examiner

BRAIDING MACHINE AND METHOD OF FORMING A BRAIDED ARTICLE USING SUCH BRAIDING MACHINE

BACKGROUND

Conventional articles of footwear generally include two primary elements: an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g., textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch resistance, wear resistance, flexibility, air permeability, compressibility, comfort, and moisture wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear, which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

SUMMARY

In one aspect, a method of forming a braided upper is disclosed. The method includes locating a forming mandrel above a braiding point of a braiding machine. The method further includes braiding a plurality of strands to form a three dimensional braided component. Further, the method includes pulling the braided component over the forming mandrel. Additionally, the method includes inserting a last into the braided component to shape the braided component.

In another aspect, a method of forming a braided upper is disclosed. The method includes locating a forming mandrel within a braiding point of a braiding machine. Further, the method includes braiding a plurality of strands to form a three dimensional braided component. Additionally the method includes pulling the braided component over the forming mandrel. The method further includes inserting a last into the braided component.

In another aspect a method of forming a braided upper is disclosed. The method includes braiding a tube structure using a braiding machine. The method further includes inserting a last into the tube structure. Additionally, the method includes conforming the tube structure to a shape of the last.

In another aspect, a braiding machine system includes a support structure. The braiding machine system further includes a plurality of rotor metals arranged along a track on the support structure. The braiding system includes a forming mandrel, a portion of the forming mandrel extending through a braiding point. Further, the braiding system includes a securing portion securing the forming mandrel to the support structure of the braiding machine. And at least one of the plurality of rotor metals is selectively movable.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

For clarity, the detailed descriptions herein describe certain exemplary embodiments, but the disclosure herein may be applied to any article of footwear comprising certain features described herein and recited in the claims. In particular, although the following Detailed Description discusses exemplary embodiments in the form of footwear such as running shoes, jogging shoes, tennis, squash or racquetball shoes, basketball shoes, sandals, and flippers, the disclosures herein may be applied to a wide range of footwear or possibly other kinds of articles.

The term "sole" as used herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole, and an inner sole.

The term "overbraid" as used herein shall refer to a method of braiding that forms along the shape of a three-dimensional structure. An object that is overbraided includes a braid structure that extends around the outer surface of object. An object that is overbraided does not necessarily include a braided structure encompassing the entire object; rather, an object that is overbraided includes a seamless braided structure that extends from back to front of the object.

The term "jacquard" as used throughout this Detailed Description is used to describe a function of a braiding machine. A jacquard machine is able to control the movement of each thread within a machine. Additionally, a jacquard portion or structure refers to a portion formed through the individual control of each thread. The use of independent spool control may allow for the creation of braided structures, such as lace braids, that have an open and complex topology, and may include various kinds of stitches used in forming intricate braiding patterns. Additionally, a jacquard motion refers to the motion of spools in which each spool may be individually controlled. In contrast, "non-jacquard" refers to an alternate function of a braiding machine. A non-jacquard machine is not able to individually control the movement of each thread within the machine. Rather, the threads extend in a predetermined manner. Additionally, a non-jacquard portion may refer to a portion formed without individual control of threads. Additionally, a non-jacquard portion may refer to a portion formed on a machine that utilizes the motion of a non-jacquard machine. A non-jacquard motion, in reference to braiding, refers to the continuous oscillating motion of spools.

Figure 1:
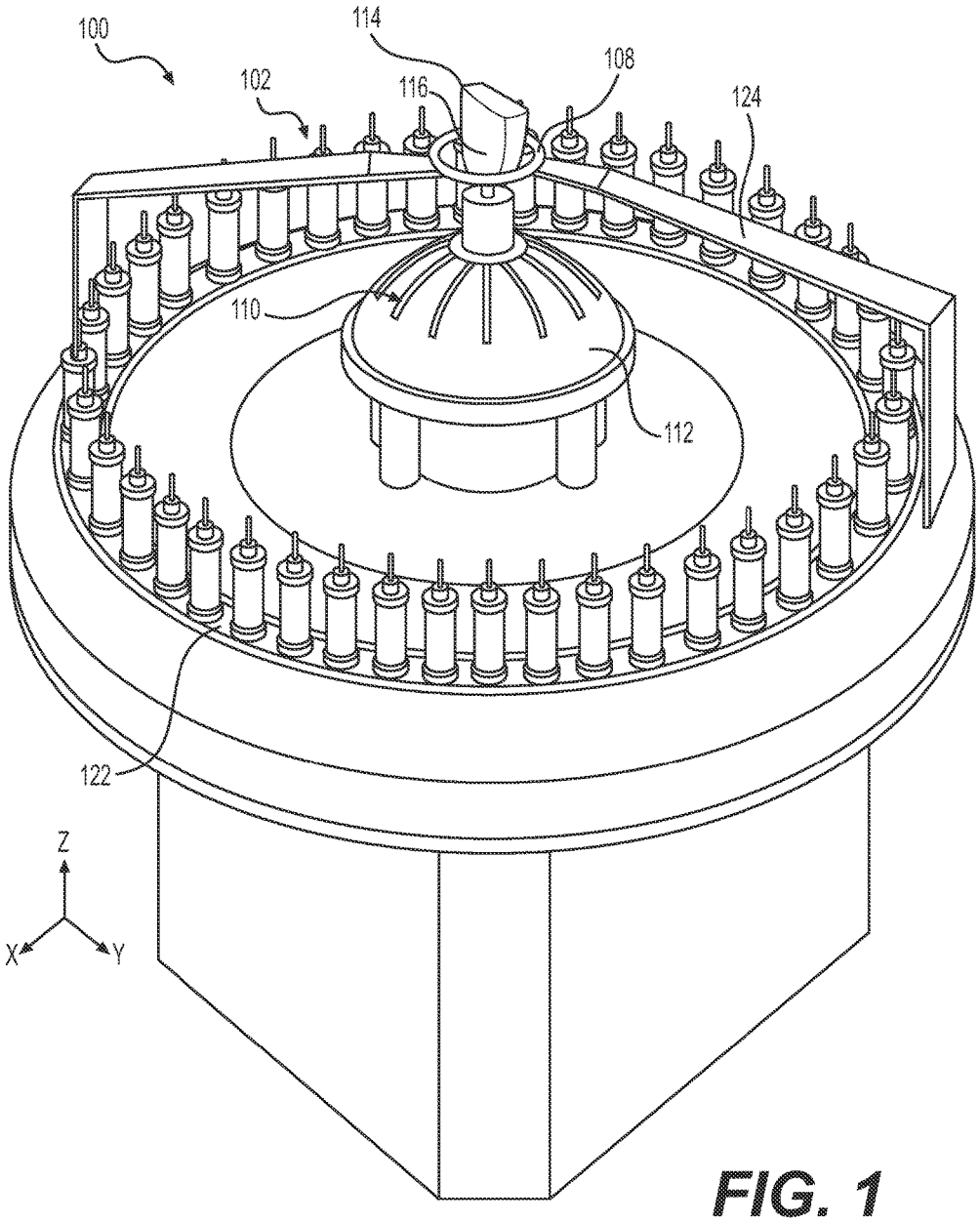
FIG. 1 is a schematic view of an embodiment of a lace braiding machine.

Referring to FIG. 1, a braiding machine is depicted. Braiding machine 100 includes a plurality of spools 102. In some embodiments, plurality of spools 102 may include strands or threads 120 (see FIG. 3). Threads 120 of plurality of spools 102 may intertwine and twist with one another. This twisting and intermeshing of strands may form a braided structure.

Threads 120 may be wrapped around each of the spools of plurality of spools 102 such that as threads 120 are tensioned or pulled, each thread may unwind or unwrap from plurality of spools 102. Threads 120 may be oriented to extend through ring 108 and form a braided structure.

Braided structures can be formed as tubular braids and flat braids. Lace braiding machines are used to form flat braided structures. An example of a lace braiding machine can be found in Malhere, U.S. Pat. No. 165,941, granted Jul. 27, 1875, entitled "Lace-Machine," the entirety of which is hereby incorporated by reference. Another example of a lace braiding machine can be found in Ichigawa, EP No. 2 657 384, published Oct. 30, 2013 entitled "Torchon Lace Machine," the entirety of which is hereby incorporated by reference. Lace braiding machines may form intricate designs that may involve twisting yarn or intertwining yarn in various manners. Lace braiding machines are machines that include rotor metals that may individually rotate. Radial braiding machines and axial braiding machines are generally used to form tubular structures. In this Detailed Description, reference to radial braiding machines incorporates axial braiding machines. Radial braiding machines, as used in this Detailed Description, refers to braiding machines that utilize a non-jacquard motion. As used in this Detailed Description, radial braiding machines form non-jacquard braided structures. Additionally, radial braided portions may refer to portions that are formed using a non-jacquard motion. Radial braiding machines incorporate intermeshed horn gears. An example of a radial braiding machine is described in Richardson, U.S. Pat. No. 5,257,571, granted Nov. 2, 1993, entitled "Maypole Braider Having a Three Under and Three Over Braiding Path," the entirety of which is hereby incorporated by reference. Additionally, another example of a radial braiding machine is described in Dow et al., U.S. Pat. No. 7,908,956, granted Mar. 22, 2011, entitled "Machine for Alternating Tubular and Flat Braid Sections," the entirety of which is hereby incorporated by reference. The braided structure or format of the strands of the braided structure formed in a radial braiding machine is generally the same or similar throughout the length of the radial braided structures. That is, there may be little or no variation in the braided structure or pattern of a structure formed on a radial braiding machine. The braided structure is referred to as a non-jacquard braided structure. Radial braiding machines and lace braiding machines are discussed in further detail in the Detailed Description.

The embodiments may also utilize any of the machines, devices, components, parts, mechanisms, and/or processes related to a braiding machine as disclosed in Bruce et al., U.S. Patent Publication No. 2016/0345677, published Dec. 01, 2016 (U.S. patent application No. 14/721,614, filed May 26, 2015), titled "Braiding Machine and Method of Forming an Article Incorporating a Moving Object," the entirety of which is herein incorporated by reference and hereafter referred to as the "Moving Last Braiding" application.

In some embodiments, plurality of spools 102 may be located in a position guiding system. In some embodiments, plurality of spools 102 may be located within a track. As shown, track 122 may secure plurality of spools 102 such that as threads 120 are tensioned or pulled, plurality of spools 102 may remain within track 122 without falling over or becoming dislodged.

In some embodiments, track 122 may be secured to a support structure. In some embodiments, the support structure may elevate the spools off of a ground surface. Additionally, a support structure may secure a brace or enclosure, securing portion, or other additional parts of a braiding machine.

Threads 120 may be formed of different materials. The properties that a particular type of thread will impart to an area of a braided component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the thread selected for formation of a braided component may affect the properties of the braided component. For example, a thread may be a monofilament thread or a multifilament thread. The thread may also include separate filaments that are each formed of different materials. In addition, the thread may include filaments that are each formed of two or more different materials, such as a bicomponent thread with filaments having a sheath-core configuration or two halves formed of different materials.

In some embodiments, plurality of spools 102 may be evenly spaced around a perimeter portion of braiding machine 100. In other embodiments, plurality of spools 102 may be spaced differently than as depicted in FIG. 1. For example, in some embodiments, about half the number of spools may be included in plurality of spools 102. In such embodiments, the spools of plurality of spools 102 may be spaced in various manners. For example, in some embodiments, plurality of spools 102 may be located along 180 degrees of the perimeter of the braiding machine. In other embodiments, the spools of plurality of spools 102 may be spaced in other configurations. That is, in some embodiments, each spool may not be located directly adjacent to another spool.

Figure 23:
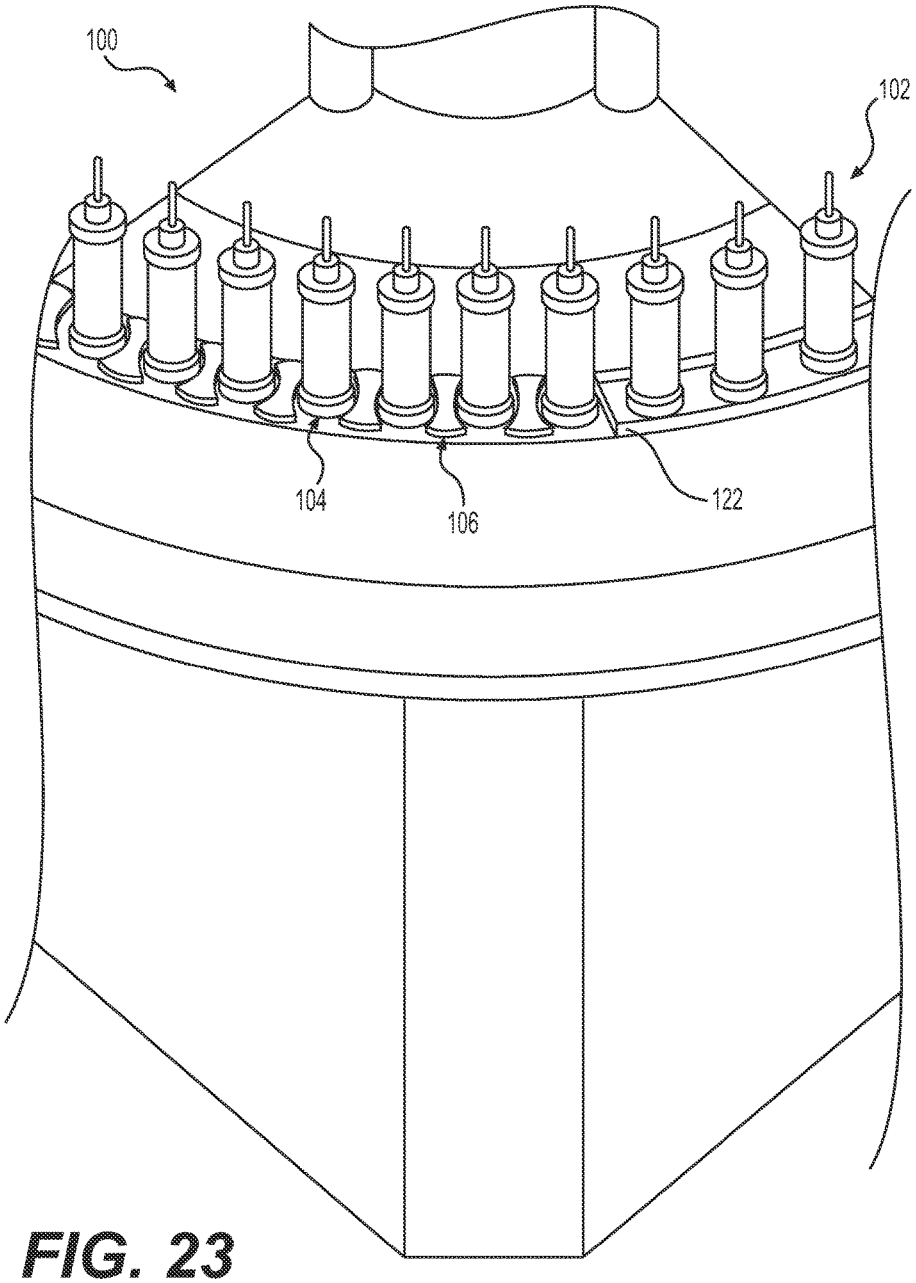
FIG. 23 is a cutaway view of an embodiment of a braiding machine.

In some embodiments, plurality of spools 102 are located within gaps 104 (see FIG. 23) that are located between each of the rotor metals 106 (see FIG. 23). Rotor metals 106 may rotate clockwise or counterclockwise, contacting plurality of spools 102. The contact of rotor metals 106 with plurality of spools 102 may force the plurality of spools 102 to move along track 122. The movement of the plurality of spools 102 may intertwine the threads 120 (see FIG. 3) from each of the plurality of spools 102 with one another. The movement of plurality of spools 102 additionally transfers each of the spools from one gap to another gap of gaps 104.

In some embodiments, the movement of plurality of spools 102 may be programmable. In some embodiments, the movement of plurality of spools 102 may be programmed into a computer system. In other embodiments, the movement of plurality of spools 102 may be programmed using a punch card or other device. The movement of plurality of spools 102 may be pre-programmed to form particular shapes, designs, and thread density of a braided component.

In some embodiments, individual spools may travel completely around the perimeter of braiding machine 100. In some embodiments, each spool of plurality of spools 102 may rotate completely around the perimeter of braiding machine 100. In still further embodiments, some spools of plurality of spools 102 may rotate completely around the perimeter of braiding machine 100 while other spools of plurality of spools 102 may rotate partially around braiding machine 100. By varying the rotation and location of individual spools of plurality of spools 102, various braid configurations may be formed.

In some embodiments, each spool of plurality of spools 102 may not occupy each of gaps 104. In some embodiments, every other gap of gaps 104 may include a spool. In other embodiments, a different configuration of spools may be placed within each of the gaps 104. As rotor metals 106 rotate, the location of each of the plurality of spools 102 may change. In this manner, the configuration of the spools and the location of the spools in the various gaps may vary throughout the braiding process.

A braiding machine may be arranged in various orientations. For example, braiding machine 100 is oriented in a horizontal manner. In a horizontal configuration, plurality of spools 102 are placed in a track that is located in an approximately horizontal plane. The horizontal plane may be formed by an X axis and a Y axis. The X axis and Y axis may be perpendicular to one another. Additionally, a Z axis may be related to height or a vertical direction. The Z axis may be perpendicular to both the Y axis and the X axis. As plurality of spools 102 rotate around braiding machine 100, plurality of spools 102 pass along track 122 that is located in the horizontal plane. In this configuration, each of plurality of spools 102 locally extends in a vertical direction. That is, each of the spools extends vertically perpendicular to track 122. In other embodiments, a vertical lace braiding machine may be utilized. In a vertical configuration, the track is oriented in a vertical plane.

In some embodiments, a lace braiding machine may include a thread organization member. The thread organization member may assist in organizing the strands or threads such that entanglement of the strands or threads may be reduced. Additionally, the thread organization member may provide a path or direction through which a braided structure is directed. As depicted, braiding machine 100 may include a fell or ring 108 to facilitate the organization of a braided structure. The strands or threads of each spool extend toward ring 108 and through ring 108. As threads 120 extend through ring 108, ring 108 may guide threads 120 such that threads 120 extend in the same general direction.

Additionally, in some embodiments, ring 108 may assist in forming the shape of a braided component. In some embodiments, a smaller ring may assist in forming a braided component that encompasses a smaller volume. In other embodiments, a larger ring may be utilized to form a braided component that encompasses a larger volume.

In some embodiments, ring 108 may be located at the braiding point. The braiding point is defined as the point or area where threads 120 consolidate to form a braid structure. As plurality of spools 102 pass around braiding machine 100, thread from each spool of plurality of spools 102 may extend toward and through ring 108. Adjacent or near ring 108, the distance between thread from different spools diminishes. As the distance between threads 120 is reduced, threads 120 from different spools intermesh or braid with one another in a tighter fashion. The braiding point refers to an area where the desired tightness of threads 120 has been achieved on the braiding machine.

In some embodiments, a tensioner may assist in providing the strands with an appropriate amount of force to form a tightly braided structure. In other embodiments, knives 110 may extend from enclosure 112 to "beat up" the strands and threads so that additional braiding may occur. Additionally, knives 110 may tighten the strands of the braided structure. Knives 110 may extend radially upward toward threads 120 of the braided structure as threads 120 are braided together. Knives 110 may press and pat the threads upward toward ring 108 such that the threads are compacted or pressed together. In some embodiments, knives 110 may prevent the strands of the braided structure from unraveling by assisting in forming a tightly braided structure. Additionally, in some embodiments, knives 110 may provide a tight and uniform braided structure by pressing threads 120 toward ring 108 and toward one another. In other Figures in this Detailed Description, knives 110 may not be depicted for ease of viewing. Although not depicted, knives 110 may be present in braiding machine 100.

In some embodiments, an object may be utilized to form the shape or volume of the braided component. In other embodiments, an object may further assist in organizing the strands as the braided structure extends over the object. In further embodiments, the object may stretch or deform the braided structure as the braided structure extends over the object. In some embodiments, the object may be a forming mandrel. A forming mandrel may include a last, a last-shaped object, or another type of object. For example, a forming mandrel could include a leg-shaped object used for forming a braided pant leg, or an arm-shaped object for forming a sleeve of a shirt or sweater. Further, a forming mandrel may include other shaped objects such as a seat cushion-shaped object that may be used to form a braided seat cover. Other shaped objects may be used as forming mandrels depending on the desired shape of the braided structure.

In some embodiments, forming mandrel 114 may resist the shrinkage of a braided structure formed on braiding machine 100. As a braided structure is formed on braiding machine 100, the braided structure may revert to a tightly formed tubular structure. By utilizing a forming mandrel near the braiding point, the threads 120 of a braided structure may be stretched to the appropriate dimension for formation of an article. In some embodiments, forming mandrel 114 may be located above ring 108 or after the braiding point.

In some braiding machines and embodiments, the braided structure may extend vertically downward or toward the braiding machine after passing a ring and the braiding point. In such embodiments, the thread from spools may pass over a ring and through the ring. This is an alternate configuration for braiding machines. In such embodiments, forming mandrel 114 may be located below the braiding point toward the braiding machine.

Figure 2:
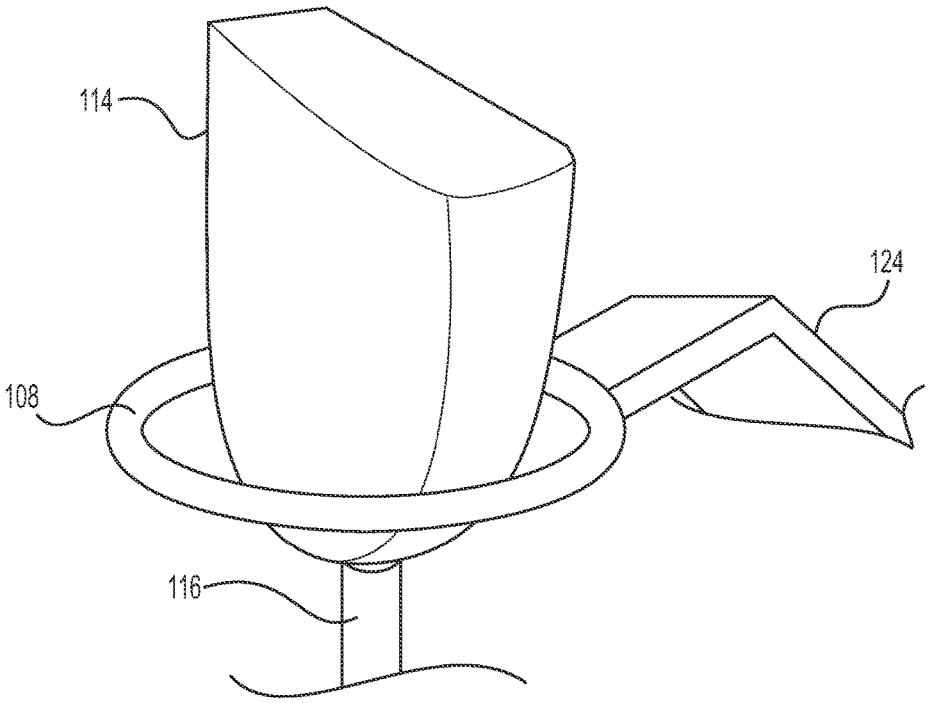
FIG. 2 is a schematic view of a forming mandrel.

Referring to FIG. 2, an enlarged view of a forming mandrel is depicted. In some embodiments, forming mandrel 114 may be in a fixed position with respect to braiding machine 100. In some embodiments, forming mandrel 114 may be secured above ring 108. In some embodiments, forming mandrel 114 may be secured using a securing portion 116. Securing portion 116 may extend from an end of forming mandrel 114 through ring 108. In some embodiments, securing portion 116 may extend from above ring 108 to below ring 108. In some embodiments, securing portion 116 may be fixed to an area or portion of braiding machine 100 below ring 108. In some embodiments, securing portion 116 may extend through the braiding point. In other embodiments, securing portion 116 may be located below the braiding point.

In some embodiments, securing portion 116 may assist in forming a braided component. In embodiments that include a securing portion that passes through the braiding point, the size of the securing portion may influence the size of a braided component. In some embodiments, securing portion 116 may have a large cross-sectional area. In such embodiments, the braided component may have a large cross section. In other embodiments, securing portion 116 may have a smaller cross section and assist in forming a braided component with a smaller cross section.

The location of securing portion 116 may be varied in order to form various shapes and designs of a braided component. Additionally, by varying the location of securing portion 116, the location of forming mandrel 114 may be varied as well. Varying the location of forming mandrel 114 may also assist in varying the shape or design of a braided component. For example, a braided structure formed by a lace braiding machine where a portion of the forming mandrel is located below the ring 108 may have a different shape than a braided structure formed by a lace braiding machine where forming mandrel 114 is located entirely above ring 108. Because the braiding point is located within the plane that ring 108 is located in, extending a portion of forming mandrel 114 through ring 108 may cause the braided component to form over forming mandrel 114. By varying the location of forming mandrel 114 through ring 108, the size of the braided component may be altered.

Forming mandrel 114 may be configured in various shapes and sizes. In some embodiments, forming mandrel 114 may have the shape of a foot or last for forming an article of footwear. In other embodiments, forming mandrel 114 may have the shape of a forefoot portion of a foot or last. In other embodiments, forming mandrel 114 may be the shape of a heel portion of a foot or last. In other embodiments, forming mandrel 114 may be the shape or form of an augmented last or portion of a last. For example, in some embodiments, a flattened forefoot portion of a last may be utilized. In other embodiments, a distorted or flattened heel portion of a last may be utilized. By changing the shape and size of forming mandrel 114, differently shaped and sized articles may be formed.

In some embodiments, ring 108 may be secured to braiding machine 100. In some embodiments, ring 108 may be secured by brace 124. In other embodiments, ring 108 may be secured by other mechanisms.

Figure 3:
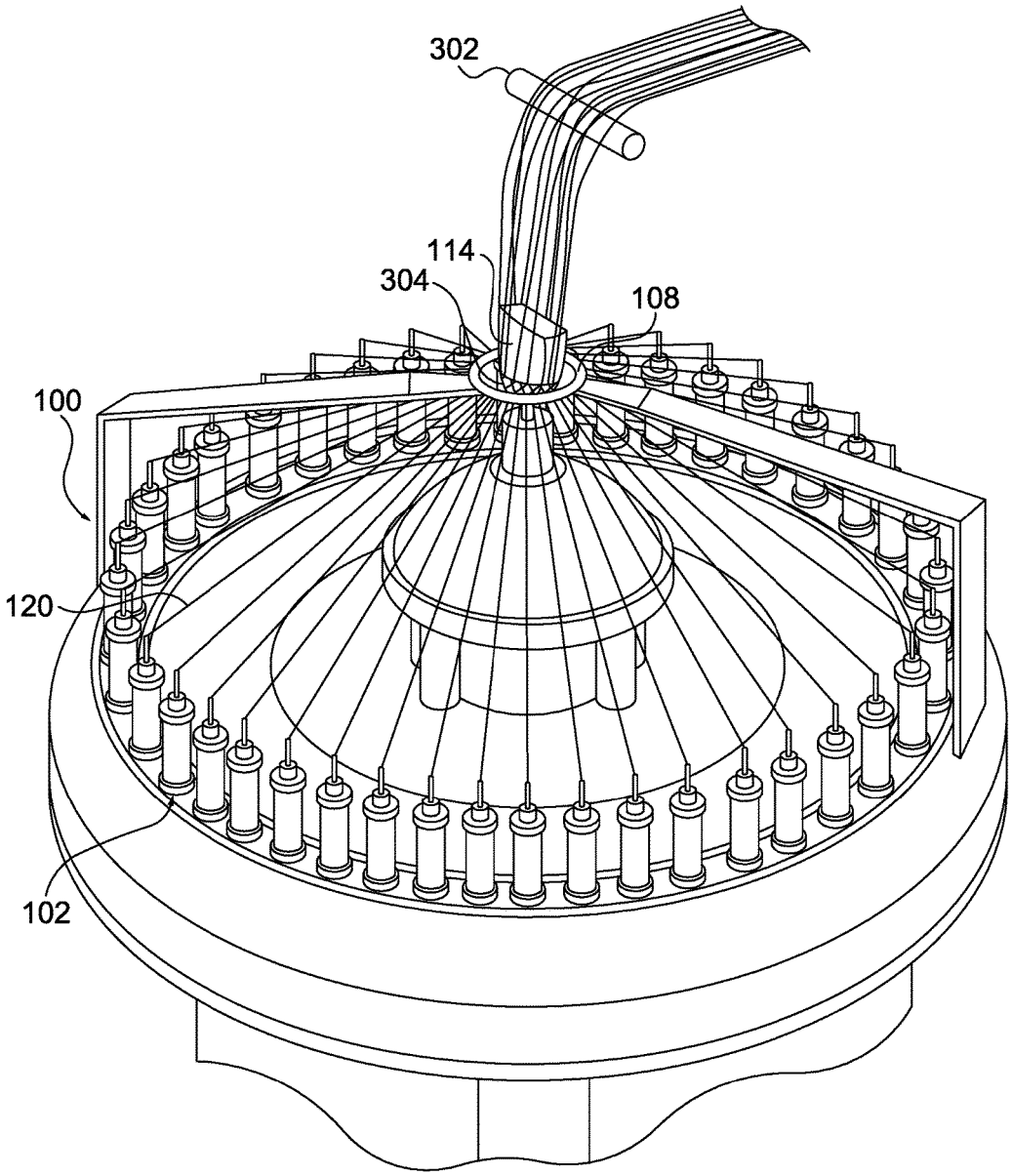
FIG. 3 is a schematic view of a forming mandrel and a braiding machine.

Referring to FIG. 3, forming mandrel 114 is depicted above ring 108. In FIG. 3, braiding machine 100 may be depicted in the early stages of braiding. That is, as depicted, braiding machine 100 is shown largely in a configuration before braiding has begun.

In this depiction, threads 120 extend around forming mandrel 114. In this depiction, threads 120 have just begun forming a braided structure. As shown, a majority of threads 120 have not been intertwined in this configuration. A small braided component 304 has been formed above ring 108. Braided component 304 has a braided structure. That is, braided component 304 incorporates three or more strands or threads that are interlaced to form a braided structure. Braided component 304 may extend from ring 108 over a portion of forming mandrel 114. As shown, threads 120 extend through ring 108. After threads 120 extend through ring 108, threads 120 extend along forming mandrel 114. Threads 120 then extend over roller 302.

In some embodiments, a braiding machine may incorporate a post-formation aligning mechanism. In some embodiments, a roller may be used. In other embodiments, a track or carrier may be used. As shown, roller 302 is used in the alignment or organization of a braided component. As braided component 304 is formed, braided component 304 may extend over roller 302. Roller 302 may assist is aligning the braided component in an organized manner such that the braided component does not become entangled with itself or with threads 120. In the depiction shown in FIG. 3, roller 302 may assist in preventing threads 120 from becoming entangled. Additionally, roller 302 may assist in altering the direction of tension that is directed along threads 120 and braided component 304. As shown, roller 302 may assist in aligning tension along a vertical direction between roller 302 and ring 108. As threads 120 extend across roller 302, the tension may extend in a horizontal direction. In this configuration, a horizontal tensile force may therefore be transitioned into a vertical tensile force by the use of roller 302. By varying the location of roller 302, the direction of a tensile force may be altered. For example, by locating a roller off center from a ring or forming mandrel, the direction of tensile force may not be vertical. In such embodiments, a braided component may become pinched or snagged along a forming mandrel or ring. By locating the roller above the forming mandrel and ring, the braided component may extend smoothly across the forming mandrel.

In some embodiments, a tensioning device may be incorporated into braiding machine 100. In some embodiments, the tensioning device may assist in guiding threads 120 over forming mandrel 114. Additionally, the tensioning device may assist in pulling a braided component around forming mandrel 114 and toward roller 302. After extending over roller 302, threads 120 may pass toward a roller carrier (not shown). In some embodiments, the roller carrier may provide tension upon threads 120 so that the threads are pulled through ring 108. In some embodiments, the roller carrier may provide tension such that the threads are pulled past forming mandrel 114 and into the roller carrier. The roller carrier may be another roller or device to store a braided structure upon completion of the braided structure.

As braided component 304 is formed, the roller carrier may pull or tension the strands to continually pull the braided component 304 along and over roller 302. The roller carrier may allow for a continuous braided component 304 to be formed. By continuously pulling or tensioning the braided component 304, multiple upper portions may be formed in a continuous tube. For example, braided component 304 may include multiple braided portions.

Figure 4:
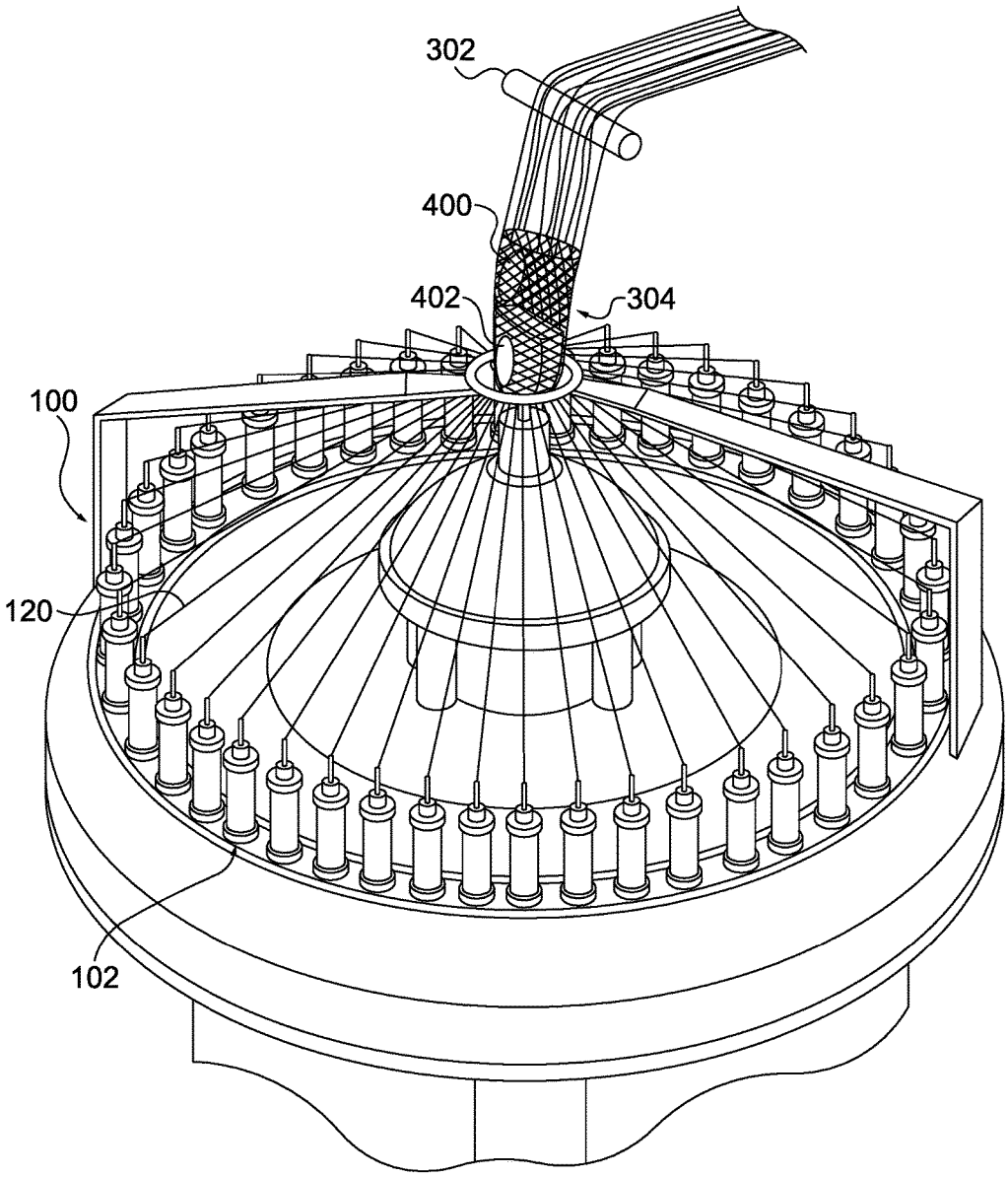
FIG. 4 is a schematic view of a braided portion extending over the forming mandrel.

Referring to FIGS. 3 and 4, the size or length of braided component 304 may be increased as braiding machine 100 continues to braid. The spools of braiding machine 100 may rotate around braiding machine 100 and pass in front of and behind one another. A tensioner may pull threads 120 and braided component 304 such that threads 120 and braided component 304 extend away from ring 108 toward forming mandrel 114. The strands and threads of plurality of spools 102 may intertwine and twist with one another to continue to form a braided component. As the strands from the spools of braiding machine 100 intertwine near the ring, the knives may compress the yarn to form an adequately tightened or sturdy braided component.

In some embodiments, braiding machine 100 may assist in providing particularized shapes and structures within braided component 304. For example, in some embodiments, braided component 304 may be particularly formed around forming mandrel 114. That is, in some embodiments, the shape of braided component 304 may correspond to the shape of forming mandrel 114.

In some embodiments, braiding machine 100 may assist in forming particular designs within braided component 304. In some embodiments, braiding machine 100 may form openings within braided component 304. In some embodiments, the openings may correspond to ankle openings or collars in an article of footwear. In other embodiments, the openings may correspond to lace apertures. In still further embodiments, the openings may correspond to an instep opening. By forming the openings during the braiding process, the efficiency of forming an upper from a braided component may be increased as compared to other methods. Further, by forming the openings during braiding, additional processing and cutting may be reduced to form the openings. As shown, braided component 304 includes opening 400 and opening 402. In this embodiment, opening 400 and opening 402 correspond to ankle openings in two articles of footwear. In other embodiments, various openings may be formed.

In some embodiments, braiding machine 100 may form a three-dimensional structure. As shown, braided component 304 is configured as a three-dimensional braided structure. In some embodiments, braided component 304 may form a tube-shaped structure. As depicted, braided component 304 may be cylindrical in shape. For example, braided component 304 may include an interior portion and an exterior portion. Additionally, braided component 304 may include a first open end and a second open end. The first open end and the second open end may be in fluid communication with one another thereby defining an interior void.

In some embodiments, a braided component may be formed to correspond to multiple articles of footwear. In some embodiments, a braided component may correspond to multiple uppers or portions of uppers. In some embodiments, each braided portion may be formed to accept a last. For example, in some embodiments, uppers or portions of uppers may be formed by a lace braiding machine such that a last may be inserted into the uppers. In some embodiments, braiding machine 100 may be able to continuously form braided portions. That is, as soon as one braided portion is finished, another braided portion may begin to be formed. This may allow for uppers to be quickly formed in succession.

Figure 5:
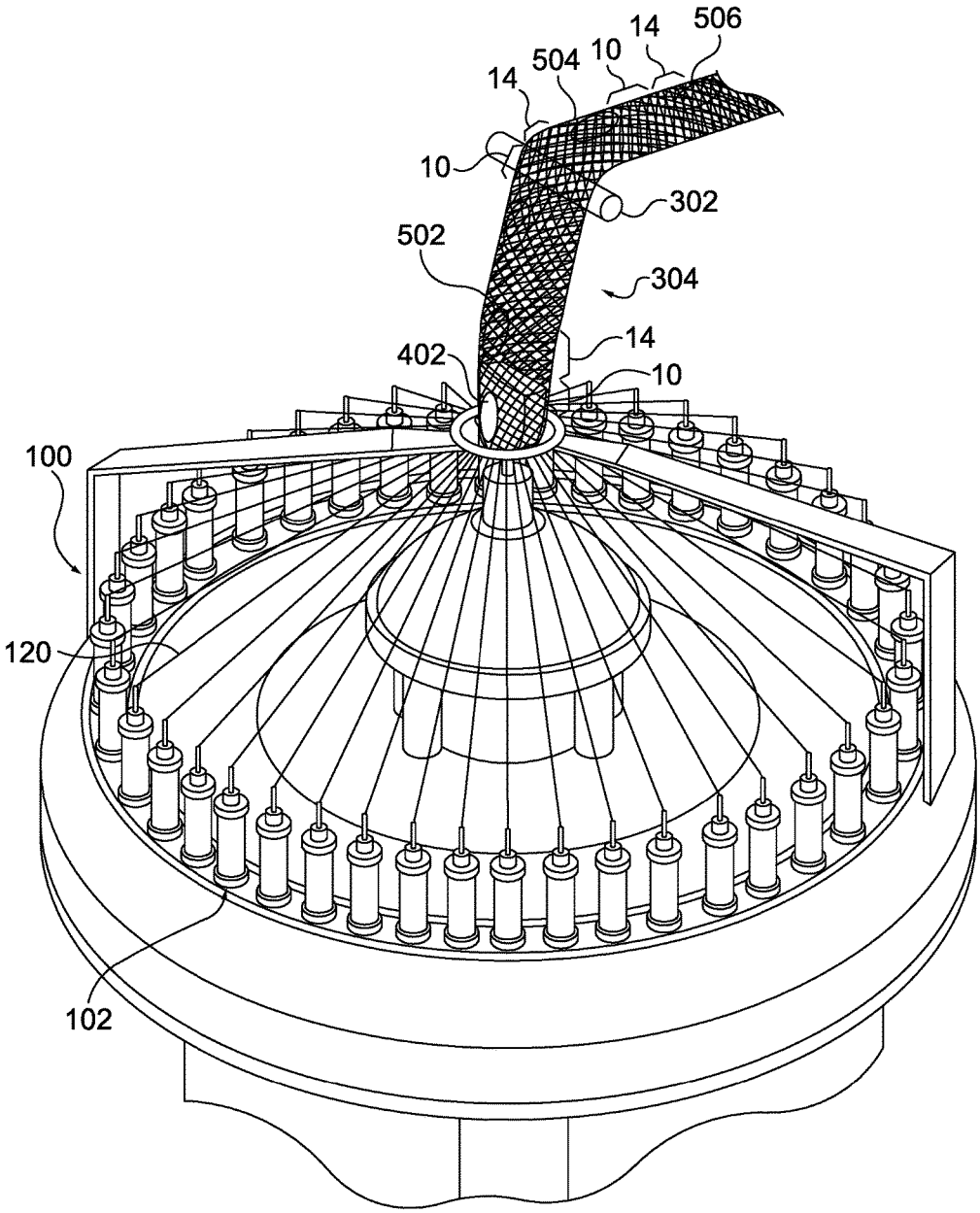
FIG. 5 is another schematic view of a braided portion extending over the forming mandrel.

Referring to FIG. 5, multiple braided portions have been formed. In this embodiment, braided portion 500, braided portion 502, braided portion 504 and braided portion 506 are formed as part of braided component 304.

In some embodiments, the braided portions may include a forefoot region, midfoot region, and a heel region. The regions are not meant as a precise demarcation; rather, the regions are referred to for ease of description.

In some embodiments, each of the braided portions may be connected to one another adjacent a forefoot region or a heel region. For example, forefoot region 10 of braided portion 500 abuts the heel region 14 of braided portion 502. Similarly, forefoot region 10 of braided portion 502 abuts heel region 14 of braided portion 504. In this configuration, each braided portion is oriented in a linear heel to toe orientation. Additionally, in this configuration, the heel region of each braided portion is formed first. In other embodiments, braided component 304 may be configured in a backwards configuration. For example, in some embodiments, a heel region of a braided portion may be formed first. In still further embodiments, various configurations may be used. For example, the forefoot portion of different braided portions may abut one another.

Figure 6:
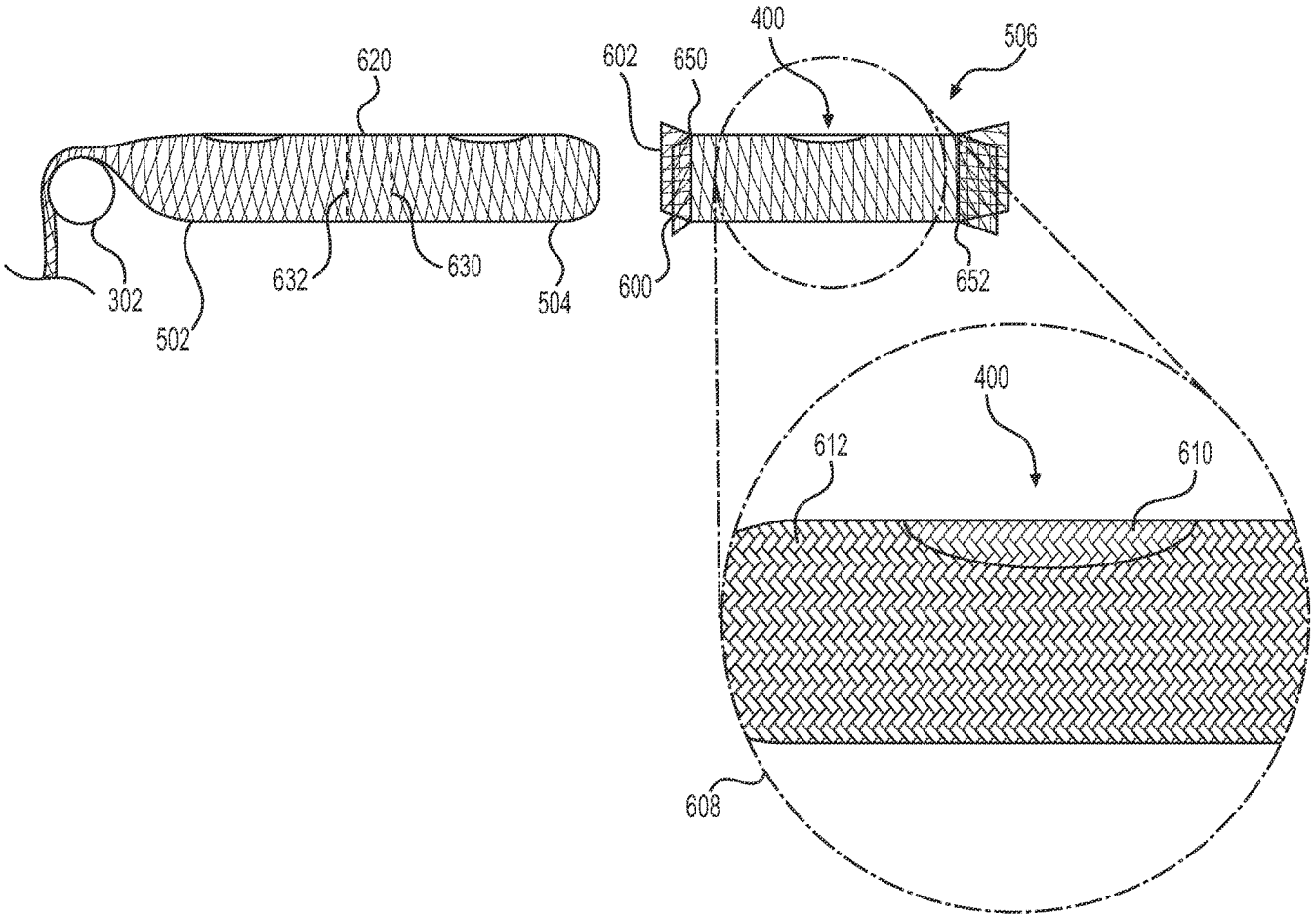
FIG. 6 is a schematic view of a portion of the braided portion being separated.

Referring to FIG. 6, a side view of the braided component of FIG. 5 is depicted. In this view, additional braiding has been performed from the view of FIG. 5. That is, the braided portions have moved along roller 302 and toward the roller carrier.

In some embodiments, an area between braided portions may be formed that provides a separation between each of the braided portions. As shown, abutment area 620 extends between braided portion 504 and braided portion 502. In some embodiments, abutment area 620 may separate braided portion 504 from braided portion 502.

The width of abutment area 620 may be varied. For example, in some embodiments, abutment area 620 may be the width of a single braid or strand. In other embodiments, abutment area 620 may be the width of multiple braids.

In some embodiments, a forming mandrel may not be utilized in the formation of braided component 304. In such embodiments, a seam or closure may be formed along each of the braided portions during the braiding process. In other embodiments, a seam or closure may be formed after the braiding process.

In some embodiments, the thickness and shape of abutment area 620 may be varied. In some embodiments, abutment area 620 may form a flat portion between braided portion 504 and braided portion 502. For example, in some embodiments, abutment area 620 may not include a void. Additionally, abutment area 620 may be a two-dimensional structure, as compared to the three-dimensional structures of braided portion 504 and braided portion 502.

In some embodiments, abutment area 620 may include a first end and a second end. In some embodiments, abutment area 620 may be sewn, stitched, or braided together along the first end and the second end. That is, first end 630 and second end 632 may be secured in that the braided portions may not move with respect to each other along first end 630 and second end 632. For example, first end 630 may be sewn, stitched, or braided along first end 630 such that first end 630 is a largely two-dimensional structure.

First end 630 and second end 632 may seal or partition the braided portions from one another. For example, the void formed by the three-dimensional structure of braided portion 504 may be separated or partitioned from abutment area 620 by first end 630. The void formed by the three-dimensional structure of braided portion 502 may be separated or partitioned from abutment area 620 by second end 632. Abutment area 620 may incorporate an area between braided portion 502 and braided portion 504 that is separated from the void or opening of braided portion 502 by second end 632 and separated from the void or opening of braided portion 504 by first end 630.

In this configuration, first end 630 may form a demarcation or separation of braided portion 504 from braided portion 502. Additionally, second end 632 may form a demarcation of braided portion 502 from braided portion 504. The separation of braided portion 502 and braided portion 504 may form separate tubes or upper portions that may be sealed or closed along forefoot region 10 and heel region 14.

In some embodiments, first end 630 and second end 632 may be formed automatically. In an exemplary embodiment, braiding machine 100 may be programmed to form first end 630 and second end 632. In some embodiments, first end 630 and second end 632 may be formed without additional processing once removed from braiding machine 100. That is, first end 630 and second end 632 may be formed automatically during the formation of braided portion 504 and braided portion 502. In other embodiments, first end 630 and second end 632 may be formed by hand. In further embodiments, first end 630 and second end 632 may be formed by another machine, such as a sewing machine. In some embodiments, a single end may be formed. That is, in some embodiments, first end 630 may be formed and second end 632 may not be formed. In still further embodiments, first end 630 and second end 632 may not be formed. In such embodiments, braided component 304 may be formed in the configuration of a hollow tube.

Although visible in FIG. 6, in some embodiments, first end 630 and second end 632 may not be visible. In other embodiments, first end 630 and second end 632 may be highlighted or otherwise marked to ensure that first end 630 and second end 632 may be visible.

In some embodiments, various braided portions of braided component 304 may be formed in a similar manner. For example, as depicted, each braided portion may be formed of the same or similar structure. In other embodiments, each braided portion may be formed of different braided configurations. For example, braided portion 502 and braided portion 504 may be formed of different braided configurations. In addition to utilizing different braid structures and configurations, braided portion 504 and braided portion 502 may be differently sized. Further, the openings in braided portion 504 and braided portion 502 may be differently shaped and sized.

In some embodiments, the braided portions may include instep areas and ankle openings. In some embodiment, the instep portions of the braided portions may be different. For example, in some embodiments, an ankle portion may be formed using a first design or braided configuration in braided portion 504. The ankle portion may be formed using a second design or braided configuration in braided portion 502 that is different than the first design. Additionally, in some embodiments, an area adjacent the instep area or ankle opening may be formed using different braided structures than other areas of the braided portion. For example, in some embodiments, an area may be braided adjacent to an ankle opening or instep area to provide strength. In some embodiments, the braided structure adjacent an instep area may be denser than other areas or may utilize a braided structure that may resist stretch and provide support.

In some embodiments, braided portion 504 may be formed to correspond to a first sized article of footwear, and braided portion 502 may be formed to correspond to a second sized article of footwear. In some embodiments, the first size may be larger than the second size. As each braided portion is formed, the plurality of spools of the braiding machine may interact with one another. By changing the frequency in which particular spools interact with one another as well as the amount of tension applied on each of the strands extending from the spools, the size of each of the braided portions may be altered. In this manner, different-sized braided portions having different cross-sectional areas may be formed using the same lace braiding machine and the same forming mandrel.

Referring to enlarged portion 608, braided portion 506 is depicted in detail. As shown, braided portion 506 includes an interior surface and an exterior surface. In some embodiments, a braided structure may form a portion of the interior surface of an upper. In other embodiments, a braided structure may form a portion of the exterior surface of an upper. As shown, braided portion 506 includes an interior surface 610 and an exterior surface 612 formed using a braided configuration. In other configurations, when formed for an article of footwear, braided portion 506 may include additional materials that are attached to braided portion 506. For example, in some embodiments, interior surface 610 may include a sock liner. In other embodiments, exterior surface 612 may include additional materials that are attached or printed onto exterior surface 612.

Referring to FIG. 6, in some embodiments, the braided portions may be removed from braided component 304. In some embodiments, the braided portions may be cut within an abutment area. As shown in FIG. 6, braided portion 506 is separated from braided component 304 and braided portion 504 along an abutment area that may allow access to an interior void of braided portion 506.

In some embodiments, braided portion 506 may include a heel edge and forefoot edge. Heel edge 650 and forefoot edge 652 may be similar in configuration to first end 630 and second end 632. That is, heel edge 650 and forefoot edge 652 may form a junction or seam. Additionally, braided portion 506 may include one large opening 400. Heel edge 650 and forefoot edge 652 may form the boundaries of a void formed within braided portion 506. In the embodiment depicted in FIG. 6, therefore, forefoot edge 652 and heel edge 650 may form a pocket or tube with opening 400 providing access to the void.

In some embodiments, heel edge 650 and forefoot edge 652 may be formed automatically on the braiding machine 100. In embodiments of braiding machine 100 that do not include a forming mandrel, braiding machine 100 may form the edges as each portion is formed. In embodiments that use a forming mandrel, heel edge 650 and forefoot edge 652 may be formed after braided portion 506 has passed beyond forming mandrel 114. In such embodiments, heel edge 650 and forefoot edge 652 may be formed by stitching, gluing, heat treating braided portion 506, or any other suitable method to form the edges.

In some embodiments, a free portion may extend away from heel edge 650. Free portion 600 may be defined as the area of braided portion 506 between heel edge 650 and cut end 602. Cut end 602 may be located somewhere within an abutment area. As shown, free portion 600 includes two flaps or areas. In other embodiments, free portion 600 may be a single flap. By varying the programming of braiding machine 100, a single flap or two flaps may be formed in an abutment area.

In some embodiments, the size of free portion 600 may be varied. The size of free portion 600 may be altered by changing the size of the abutment area. Additionally, by changing where cut end 602 is located, free portion 600 may be increased or decreased in size. For example, in some embodiments, the abutment area may be large. Additionally, when separating braided portion 506 from braided portion 504, the abutment area may be cut closer to braided portion 504 than heel edge 650. By cutting the abutment area closer to heel edge 650, free portion 600 of braided portion 506 may be larger than the free portion of braided portion 504. By varying the size of the abutment area along with the location of the cut line between braided portion 504 and braided portion 506, the size of each free portion may be increased or decreased as desired.

In some embodiments, the abutment area may be a relatively small area when compared to the size of braided portion 504 and braided portion 506. By locating braided portion 506 and braided portion 504 close to one another and thereby forming a small abutment area, the amount of waste may be reduced as compared to other methods.

Referring to FIGS. 7-11, braided portion 506 is depicted in isolation from braided component 304. Braided portion 506 is depicted being formed into a component of an article of footwear with the assistance of last 700.

In some embodiments, parameters of the braided process may be varied to form braided portions with various dimensions. In some embodiments, braided component 304 may be advanced toward roller 302 at different velocities. For example, in some embodiments, braided component 304 may advance at a high rate of speed toward roller 302. In other embodiments, braided component 304 may advance by a slow rate of speed. That is, braided component 304 may be formed at different rates of speeds. By changing the vertical advancement of braided component 304 toward roller 302 the density of the braided structure may vary. A lower density structure may allow for a larger braided portion. Additionally, the plurality of spools may rotate at various speeds. By varying the speed of rotation of the plurality of spools, the density of the braided structure may vary. By varying the speed of advancement of braided component 304 and the speed that plurality of spools 102 rotate, different-sized braided portions may be formed.

Figure 7:
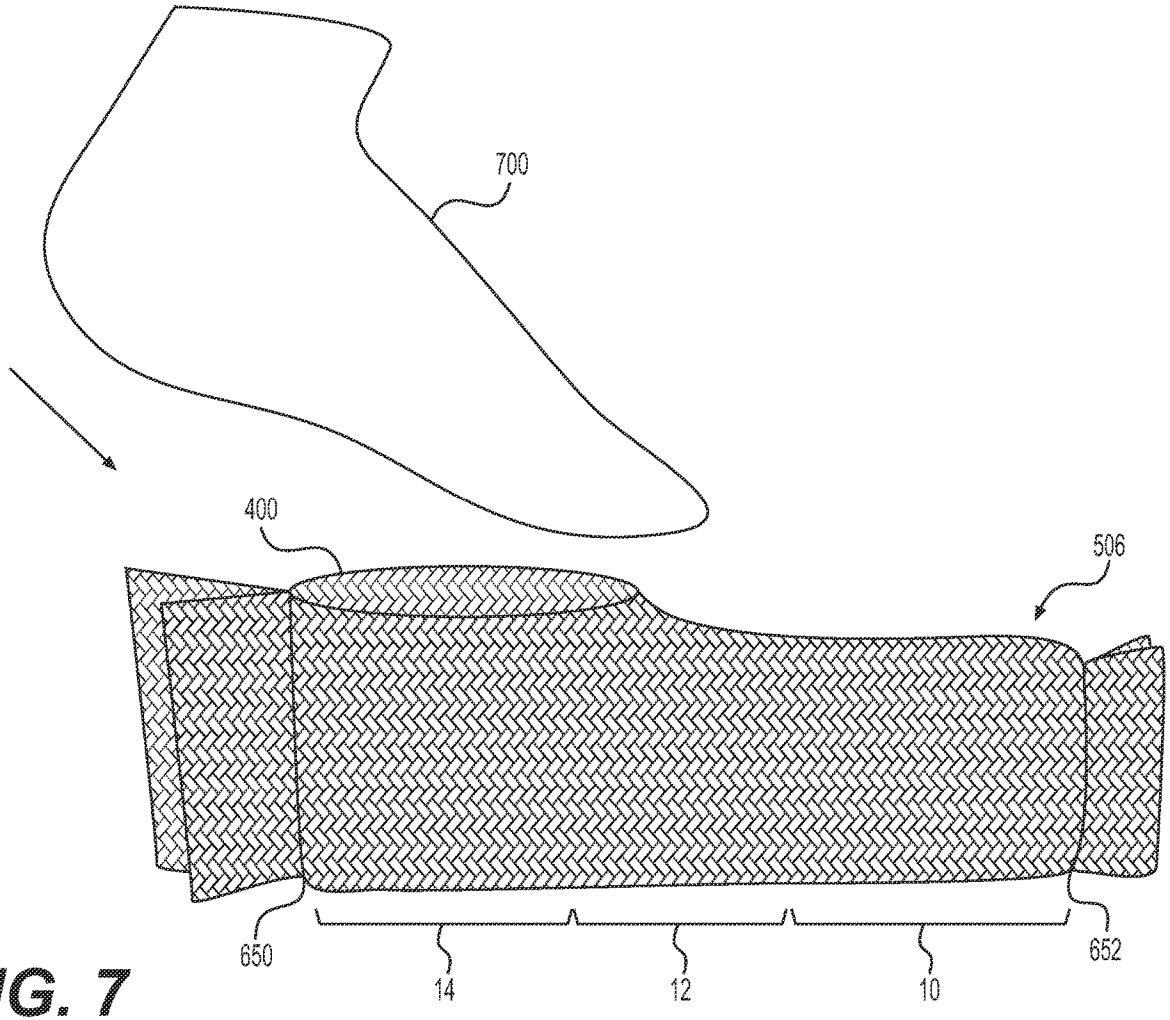
FIG. 7 is a schematic view of an embodiment of a last being inserted into a braided portion.

In some embodiments, braided portion 506 may have differing dimensions along various regions of braided portion 506. In some embodiments, such as depicted in FIG. 7, braided portion 506 may be larger in heel region 14. In other embodiments, braided portion 506 may be smaller in forefoot region 10. In this configuration, braided portion 506 may have a similar shape to that of an article of footwear.

Although braided portion 506 may have a shape similar to an article of footwear, the shape and size of braided portion 506 may be limited by the shape and size of forming mandrel 114. For example, portions of braided portion 506 may not be formed to be so small as to not be able to extend around forming mandrel 114. In some embodiments, however, braided portion 506 may include areas that are smaller than forming mandrel 114. These areas that are smaller than portions of forming mandrel 114, however, must be able to stretch around forming mandrel 114 so that braided portion 506 may continue to advance toward roller 302 and the carrier.

In some embodiments, braided portion 506 may include opening 400. In some embodiments, opening 400 may correspond to an ankle opening of an article of footwear. Opening 400 may be sized such that last 700 may be inserted into braided portion 506. In some embodiments, opening 400 may further extend toward an instep area. Further, opening 400 may extend from heel region 14 to midfoot region 12. In still other embodiments, opening 400 may extend into forefoot region 10.

Figure 30:
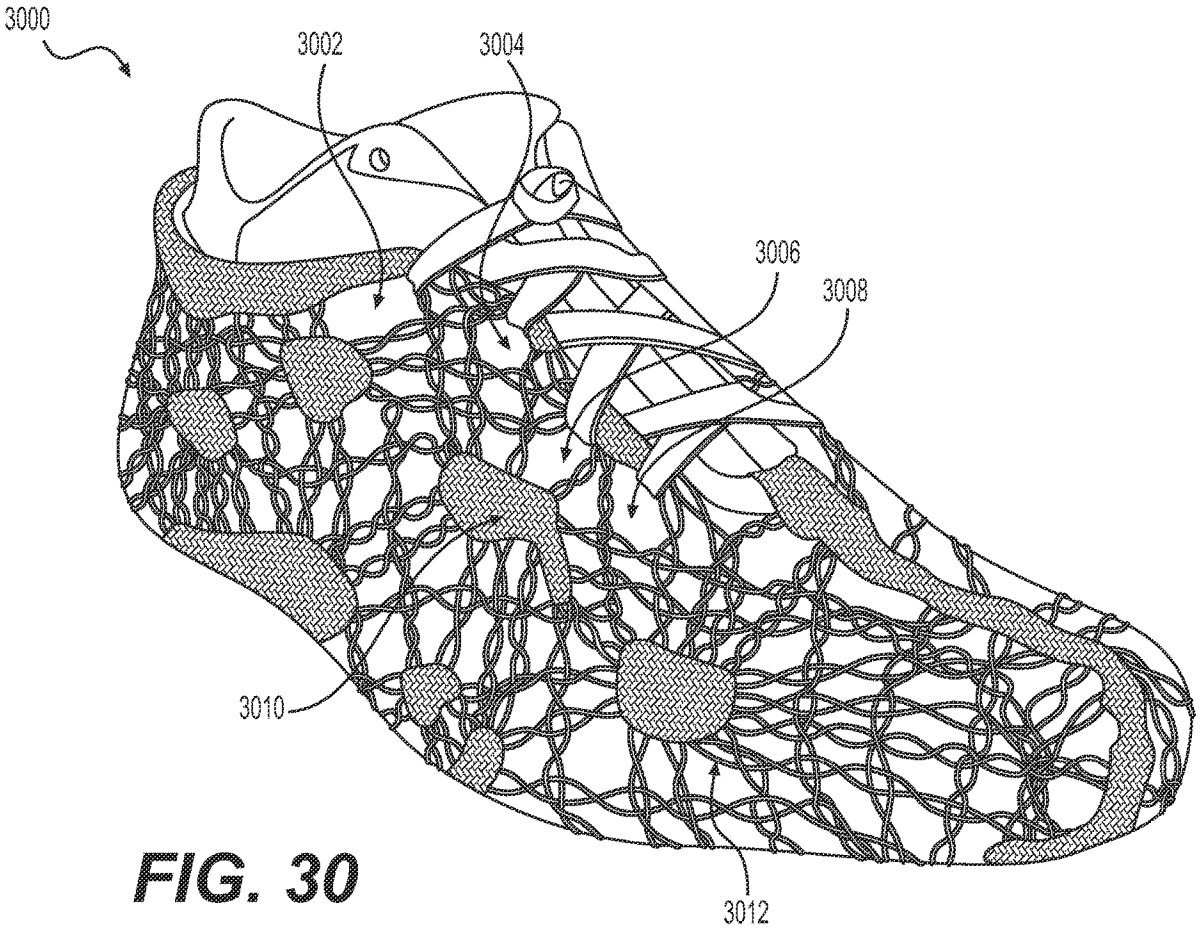
FIG. 30 is schematic view of an embodiment of an article of footwear formed using the braiding machine.

In some embodiments, the instep area may include lace apertures (see FIG. 30). In some embodiments, lace apertures may be formed during the braiding process. That is, in some embodiments, the lace apertures may be formed integrally with braided portion 506. Therefore, there may not be a need to stitch or form lace apertures after braided portion 506 is formed. By integrally forming lace apertures during manufacturing, the manufacturing process may be simplified while reducing the amount of time necessary to form an article of footwear.

Figure 8:
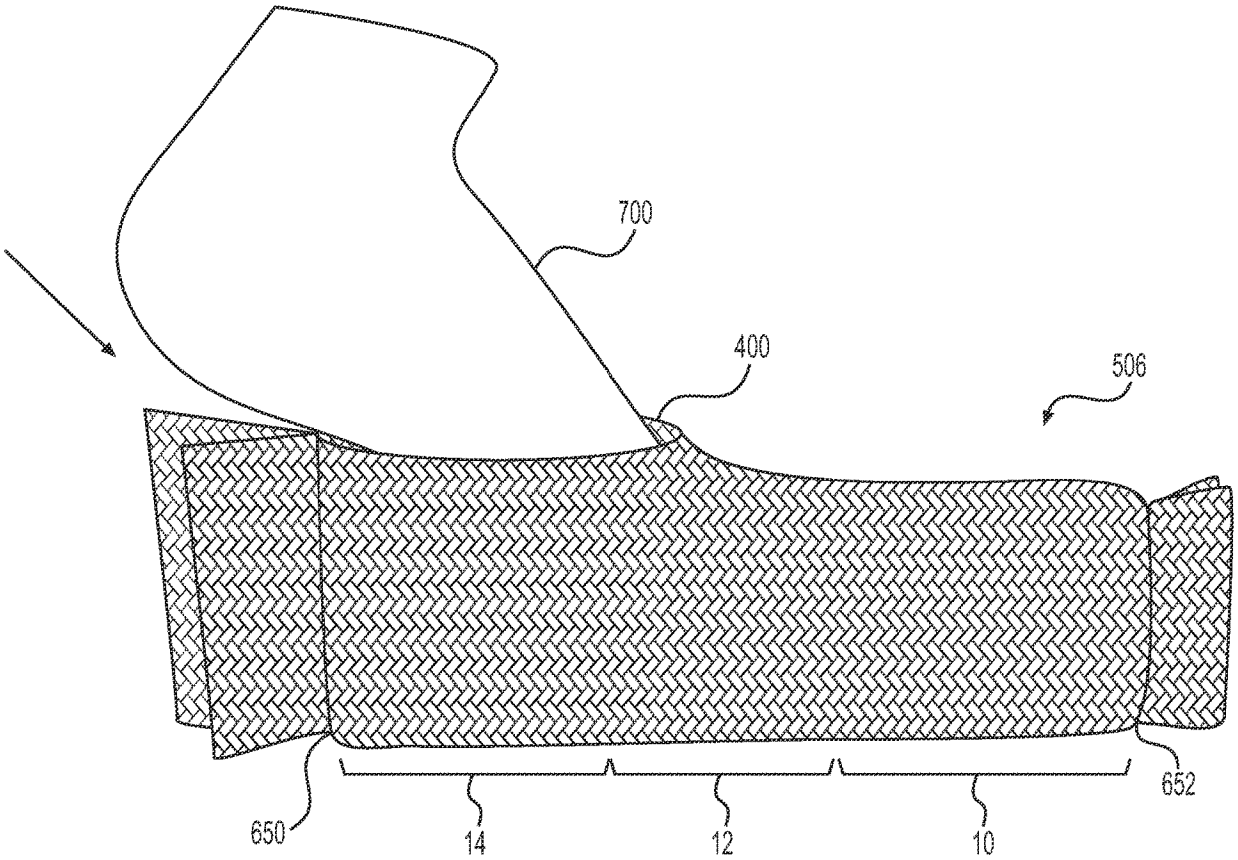
FIG. 8 is another schematic view of an embodiment of the last being inserted into a braided portion.

Referring particularly to FIG. 8, last 700 is inserted into braided portion 506 through opening 400. In some embodiments, braided portion 506 may be stretched to allow for last 700 to be inserted into braided portion 506. In other embodiments, braided portion 506 may be loose such that last 700 may be inserted without stretching braided portion 506. In still further embodiments, the physical structure of braided portion 506 may be formed such that braided portion 506 need not be stretched to accept last 700. For example, in some embodiments, an instep area may extend toward a forefoot portion from opening 400. The physical construction of a braided portion in this configuration may allow for the braided portion to be opened to accept last 700. By having a large opening to accept last 700, in some embodiments, the physical construction of braided portion 506 may allow for last 700 to be easily inserted in to braided portion 506.

Figure 9:
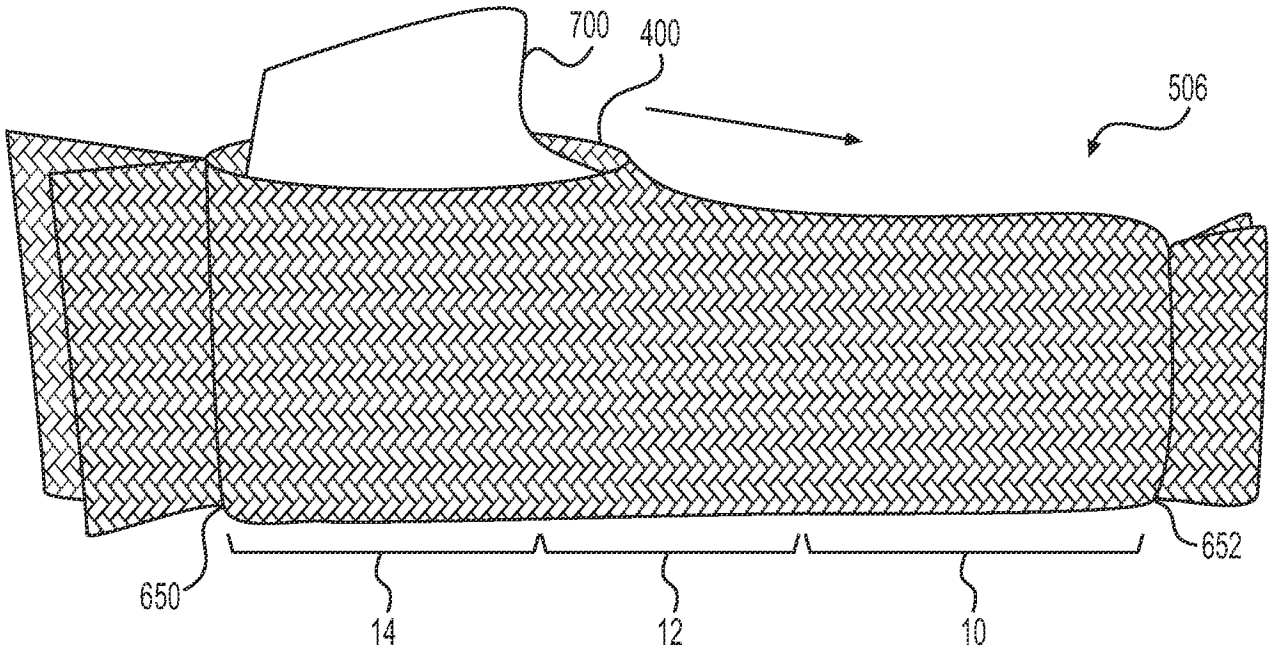
FIG. 9 is a schematic view of an embodiment of the last inserted into a braided portion.

Referring to FIG. 9, last 700 is inserted completely into braided portion 506. In some embodiments, the length of braided portion 506 may be sized such that heel edge 650 abuts the heel of last 700. In some embodiments, braided portion 506 may be sized such that forefoot edge 652 abuts the forefoot area of last 700. In other embodiments, braided portion 506 may be sized such that when last 700 is inserted into braided portion 506 there may be a space between last 700 and heel edge 650 and forefoot edge 652. That is, in some embodiments, braided portion 506 may loosely fit around last 700.

In some embodiments, braided portion 506 may be formed to loosely correspond to the shape of last 700. That is, in some embodiments, when last 700 is inserted into braided portion 506, a clearance or space may exist between last 700 and braided portion 506. In other embodiments, braided portion 506 may be formed to more closely correspond to the shape of last 700. That is, in other embodiments, the clearance or space between last 700 and braided portion 506 may be small or non-existent.

In some embodiments, braided portion 506 may be formed as a tube. In such embodiments, last 700 may be inserted through opening 400. In other embodiments, last 700 may be inserted into an opening in the heel region or forefoot region. In such embodiments, heel edge 650 and forefoot edge 652 may not be formed. In this configuration, braided portion 506 extends around last 700. That is, braided portion 506 extends over an upper portion of last 700 and a lower portion of last 700.

Figure 10:
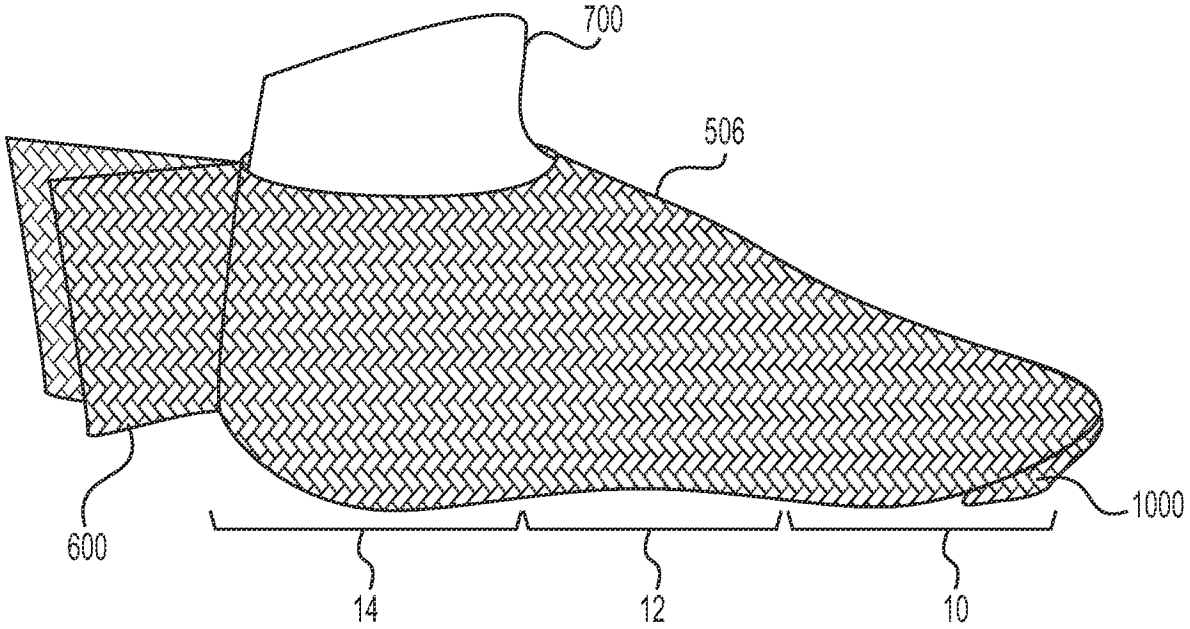
FIG. 10 is a schematic view of an embodiment of the braided portion being formed around a last.

Referring particularly to FIG. 10, last 700 is completely inserted into braided portion 506. As shown, braided portion 506 largely conforms to the shape of last 700. In some embodiments, braided portion 506 may be formed onto last 700. That is, in some embodiments, there may be slack between last 700 and braided portion 506. Braided portion 506 may therefore be tightened, wrapped, or shaped to conform to the shape of last 700.

In some embodiments, a free portion may extend from forefoot region 10 of braided portion 506. In some embodiments, a free portion 1000 of braided portion 506 may be cut or otherwise removed from braided portion 506. Additionally, in other embodiments, free portion 1000 may be wrapped below braided portion 506.

In the configuration depicted in FIG. 10, last 700 conforms braided portion 506 to the shape of an upper of an article of footwear. In some embodiments, additional pieces of fabric or may be adhered or attached to braided portion 506 while last 700 is located within braided portion 506. Further, additional processes may be performed to braided portion 506 such as heating or printing while braided portion 506 is located around last 700.

In some embodiments, a sole structure may be attached to braided portion 506. In other embodiments, a strobel may be attached to braided portion 506. In some embodiments, a sole structure may be attached to the strobel. In other embodiments, the sole structure may be attached directly to braided portion 506. Additional techniques and processes may be performed to form an article of footwear.

Figure 11:
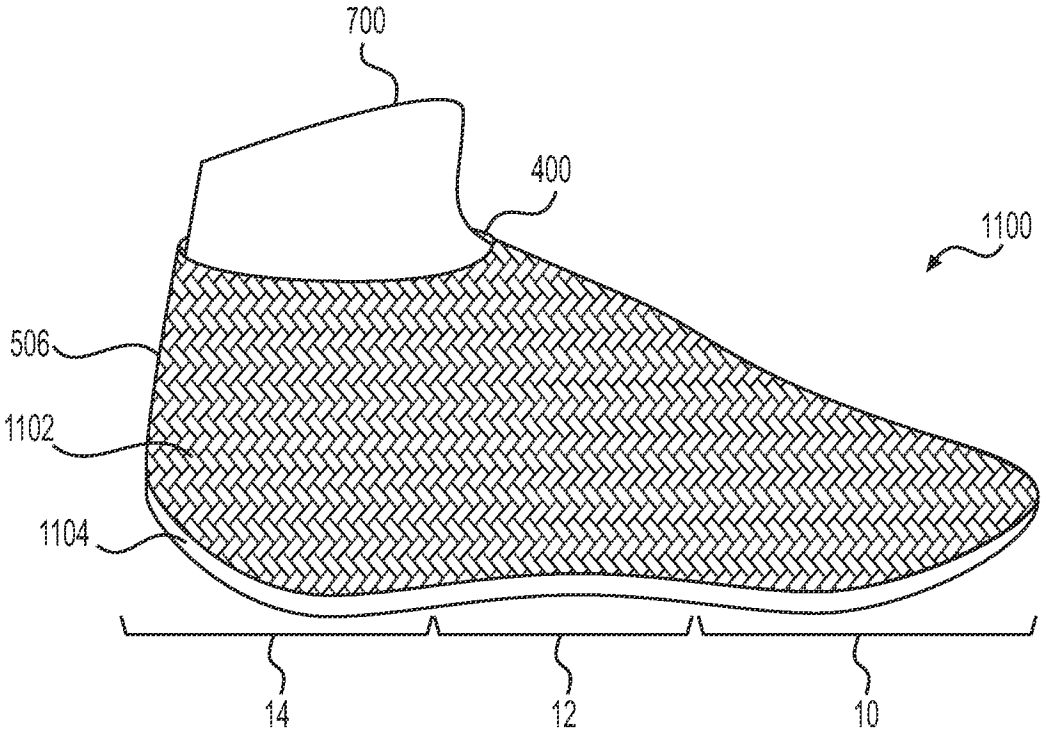
FIG. 11 is a schematic view of an embodiment of an article of footwear incorporating a braided portion.

Referring to FIG. 11, article of footwear or simply article 1100 is depicted. As shown, braided portion 506 is incorporated into article 1100 and forms a portion of upper 1102. Additionally, in some embodiments, sole structure 1104 is included and secured to upper 1102. In this manner, article 1100 is formed. Last 700 may be removed from article 1100 allowing for a foot of a user to be inserted. By using a lace braiding machine, the number of elements used to form an article of footwear may be reduced as compared to conventional methods. Additionally, by utilizing a lace braiding machine, the amount of waste formed during the manufacturing of an article of footwear may be reduced as compared to other conventional techniques.

In some embodiments, opening 400 may be various sizes. Although depicted as wrapping around an ankle portion of last 700 in heel region 14, opening 400 may extend toward forefoot region 10. In some embodiments, opening 400 may extend along an upper portion of last 700 in forefoot region 10. Additionally, opening 400 may extend from an ankle region toward sole structure 1104. That is, opening 400 may be varied in the vertical direction. For example, opening 400 may extend from an upper area adjacent the ankle area of last 700 toward sole structure 1104.

While the embodiments of the figures depict articles having low collars (e.g., low-top configurations), other embodiments could have other configurations. In particular, the methods and systems described herein may be utilized to make a variety of different article configurations, including articles with higher cuff or ankle portions. For example, in another embodiment, the systems and methods discussed herein can be used to form a braided upper with a cuff that extends up a wearer's leg (i.e., above the ankle). In another embodiment, the systems and methods discussed herein can be used to form a braided upper with a cuff that extends to the knee. In still another embodiment, the systems and methods discussed herein can be used to form a braided upper with a cuff that extends above the knee. Thus, such provisions may allow for the manufacturing of boots comprised of braided structures.

Figure 31:
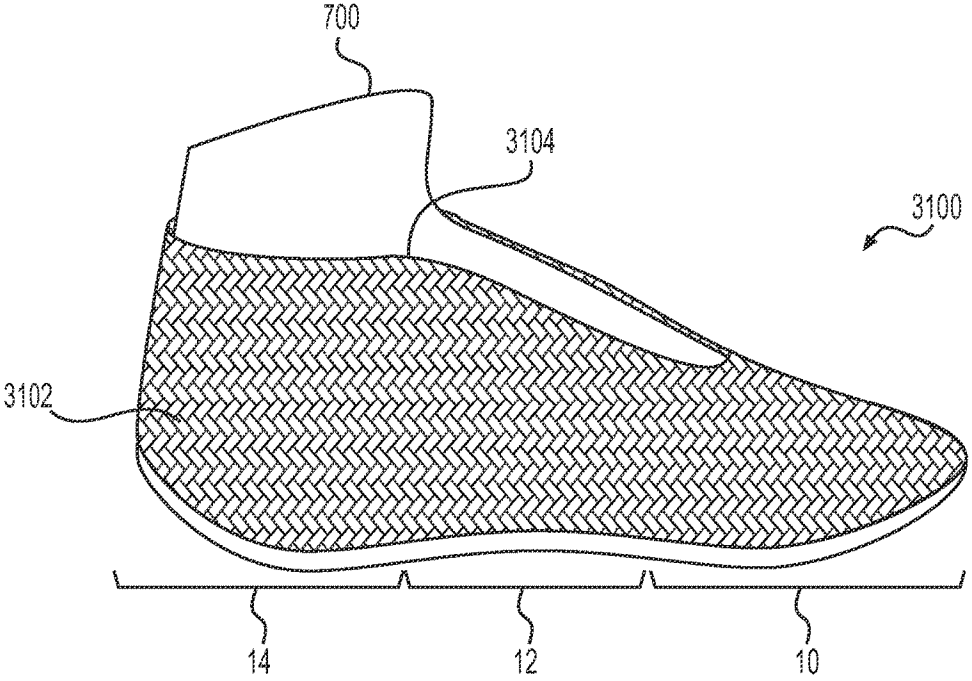
FIG. 31 is a schematic view of an embodiment of an article of footwear incorporating a braided portion.
Figure 32:
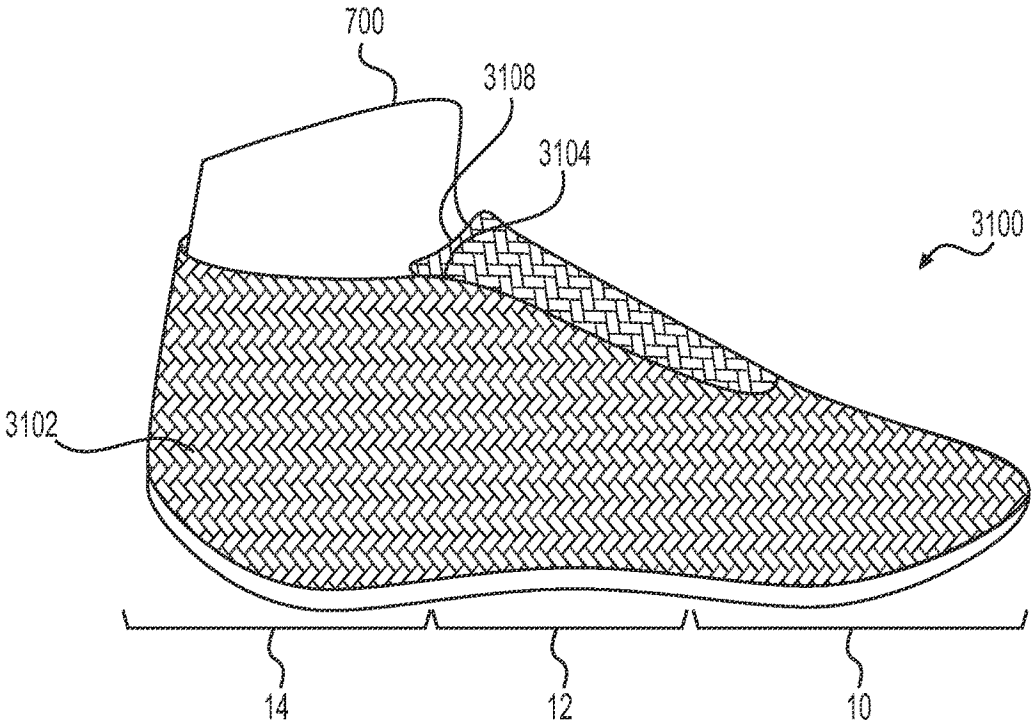
FIG. 32 is a schematic view of an embodiment of an article of footwear incorporating a braided portion including a tongue.

In other embodiments, an article of footwear may incorporate differently-shaped openings. For example, referring to FIGS. 31 and 32, upper 3102 of article 3100 includes an opening 3400. In some embodiments, opening 3400 may extend toward forefoot region 10. In such embodiments, opening 3104 may form a u-shaped throat opening. In such embodiments, opening 3104 may extend from around an ankle region and toward forefoot region 10. Additionally, the shape of opening 3104 may be different depending on the location within article 3100. For example, opening 3104 may be narrower near forefoot region 10 than in heel region 14.

In some embodiments, article 3100 may further include a tongue or other element that extends within the gap formed by opening 3104. As shown, tongue 3108 is oriented within opening 3104. Tongue 3108 extends from a lower portion of opening 3104 toward the ankle region of article 3100. In some embodiments, tongue 3108 may be formed separately from the upper 3102 used in article 3100. In some embodiments, tongue 3108 may be stitched or otherwise secured to upper 3102.

Figure 12:
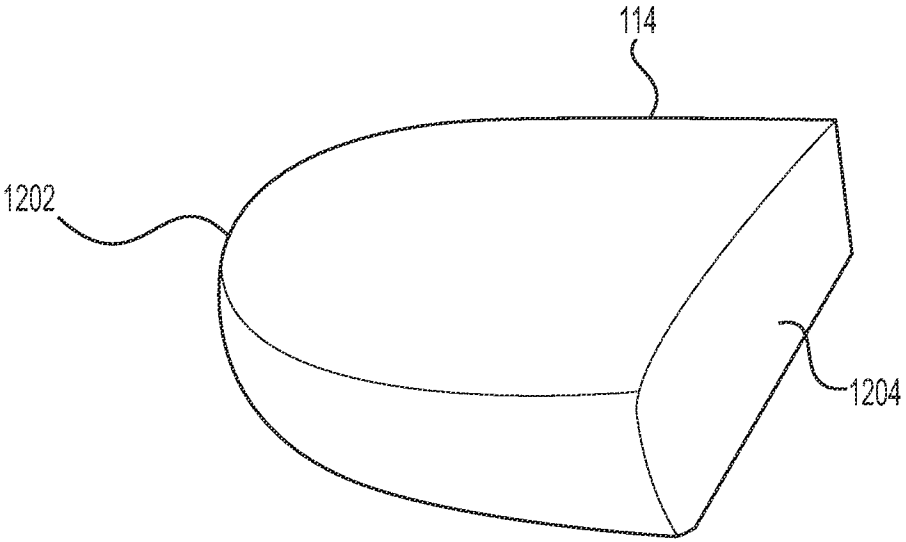
FIG. 12 is a schematic view of an embodiment of a forming mandrel.

Referring to FIG. 12, a forming mandrel is depicted. In some embodiments, forming mandrels may be shaped in similar fashion to portions of an article of footwear. For example, in some embodiments, forming mandrels may be shaped similarly to a portion of a last. As depicted in FIG. 12, forming mandrel 114 is formed in a similar manner to a forefoot portion of a last.

Forming mandrel 114 may include a forward end 1202 and a rearward end 1204. Forward end 1202 may correspond to a toe portion of an article. Rearward end 1204 may correspond to the vamp area of an article. In other embodiments, rearward end 1204 may extend from a toe portion of an article to a heel portion of an article. By varying the location of rearward end 1204 the size and shape of forming mandrel 114 may be altered.

In some embodiments, the thickness of forming mandrel 114 may be varied. In some embodiments, the thickness of forming mandrel 114 may be greater at forward end 1202 than at rearward end 1204. In other embodiments, the thickness of forming mandrel 114 may be greater at rearward end 1204 than at forward end 1202. In still further embodiments, the thickness of forming mandrel 114 may be essentially the same at forward end 1202 and rearward end 1204.

In some embodiments, the width of forming mandrel 114 may be varied. In some embodiments the width of forming mandrel 114 at forward end 1202 may be less than the width of forming mandrel 114 at rearward end 1204. In other embodiments, the width of forming mandrel 114 at forward end 1202 may be greater than the width of forming mandrel 114 at rearward end 1204. In still further embodiments, the width of forming mandrel 114 may be the same at forward end 1202 and at rearward end 1204.

Figure 13:
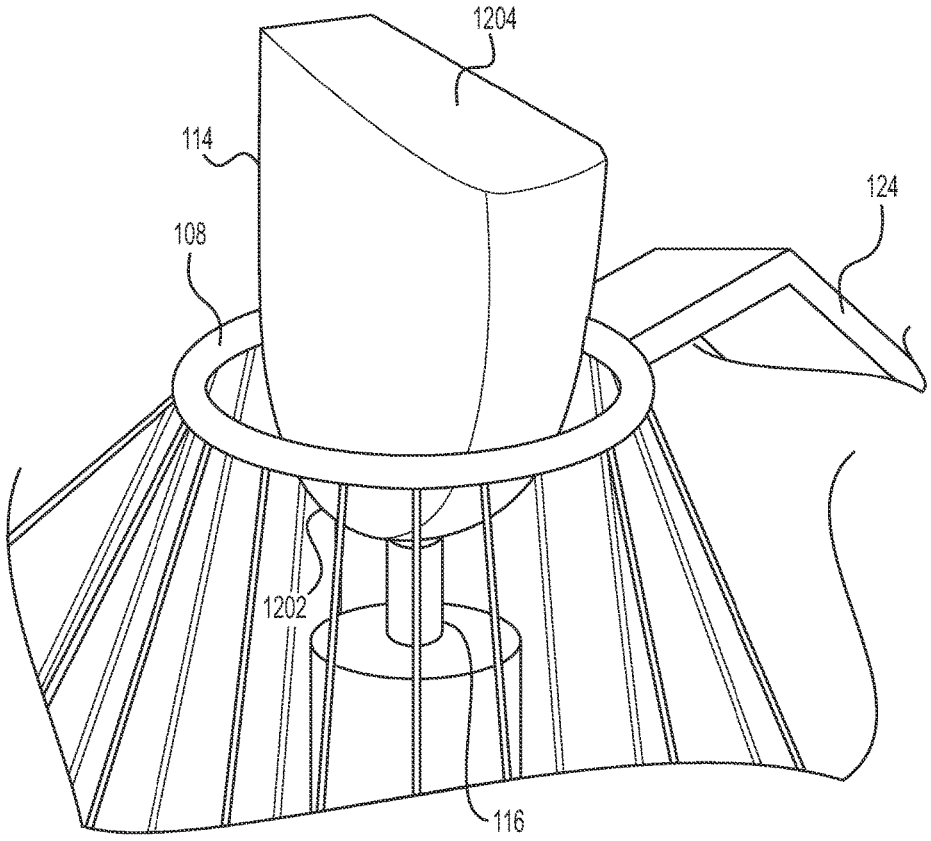
FIG. 13 is a schematic view of an embodiment of a forming mandrel mounted on a braiding machine.

Referring to FIG. 13, forming mandrel 114 is mounted on braiding machine 100. Forming mandrel 114 may be secured using securing portion 116. In some embodiments, forward end 1202 may extend through ring 108. In other embodiments, securing portion 116 may extend through ring 108. In further embodiments, securing portion 116 may be attached or otherwise secured to braiding machine 100.

In some embodiments, different-shaped forming mandrels may be attached to securing portion 116. For example, in some embodiments, forming mandrel 114 may be removed from securing portion 116. Securing portion 116 may have a universal connection mechanism to receive differently shaped forming mandrels. For example, securing portion 116 may include a threaded male end. Forming mandrel 114 may include a corresponding threaded female end. Forming mandrel 114 may then be twisted upon securing portion 116 to a desired tightness to secure forming mandrel 114 in place. In other embodiments, different mechanisms and methods may be used to exchange different forming mandrels upon a securing portion. In still further embodiments, securing portion 116 and forming mandrel 114 may be formed as a uniform piece. That is, in some embodiments, securing portion 116 and forming mandrel 114 may not be separable.

A forming mandrel may be oriented in various manners. In some embodiments, forward end 1202 may be oriented within or toward ring 108. In other embodiments, rearward end 1204 may be orientated within or toward ring 108. In still further embodiments, a side of forming mandrel 114 may be oriented within or toward ring 108. By varying the orientation of forming mandrel 114, the shape of the braided component formed by threads 120 may be varied.

Figure 14:
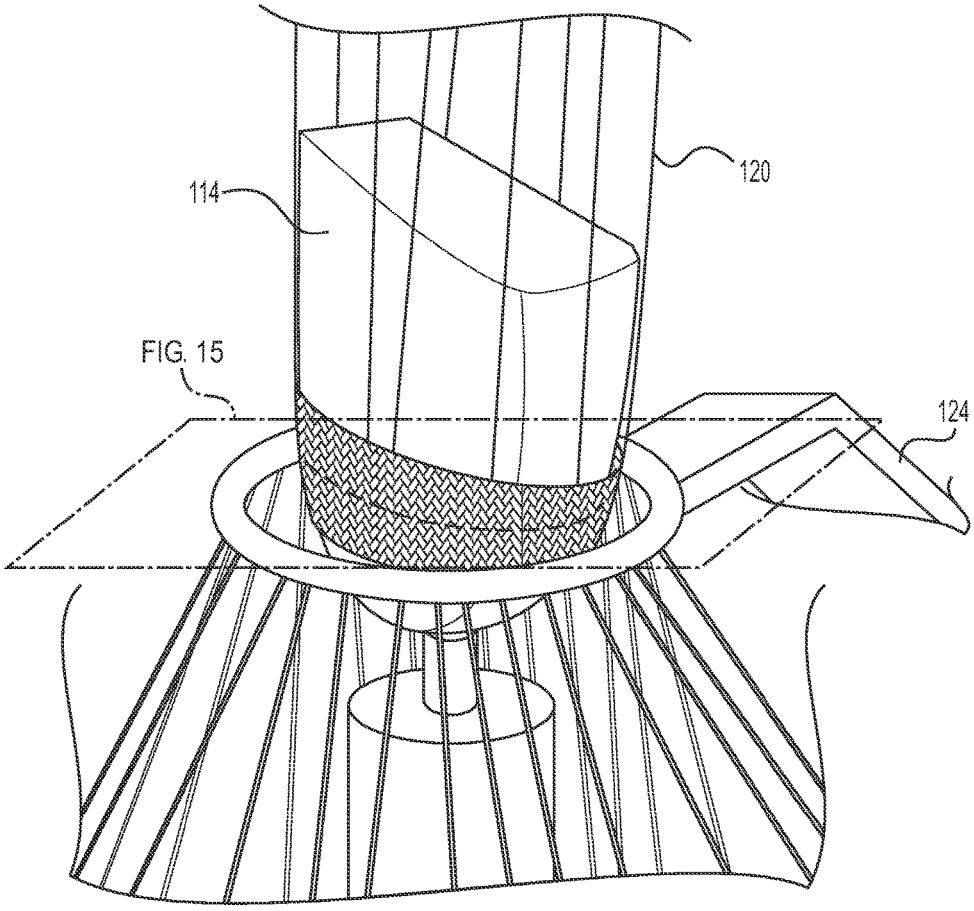
FIG. 14 is a schematic view of an embodiment of a braided portion extending over the forming mandrel.
Figure 15:
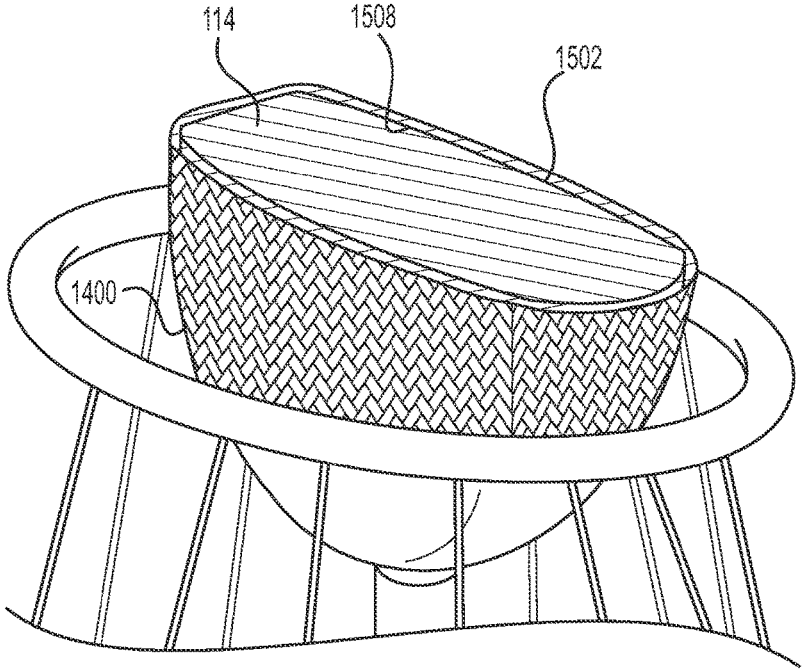
FIG. 15 is an isometric cross-sectional view of the forming mandrel and the braided portion.

Referring to FIGS. 14 and 15, a braided portion 1400 is formed over forming mandrel 114. As braided portion 1400 is formed, braided portion 1400 extends over forming mandrel 114. In some embodiments, braided portion 1400 may stretch or extend around portions of forming mandrel 114. In other embodiments, forming mandrel 114 may assist in the shape formation of braided portion 1400. In still further embodiments, forming mandrel 114 may assist in aligning braided portion 1400 as braided portion 1400 is pulled along forming mandrel 114.

Referring particularly to FIG. 15, a cross section of braided portion 1400 and forming mandrel 114 is depicted. In some embodiments, braided portion 1400 may form to the shape of forming mandrel 114. Because braided portion 1400 is pulled along forming mandrel 114, however, braided portion 1400 may not fully envelop forming mandrel 114. Rather, because braided portion 1400 is moving, braided portion 1400 may form to the cross-sectional area of forming mandrel 114. In this sense, a tube-like structure may be formed that has a similar interior cross section to that of forming mandrel 114. That is, the area enclosed by the tube structure of a braided portion 1400 may be similar to the cross-sectional area of forming mandrel 114.

In some embodiments, the interior surface of the braided structure may align with the surface of the forming mandrel. For example, interior surface 1508 of braided portion 1400 may align with mandrel surface 1502. The cross-sectional area encompassed by interior surface 1508 along the cut line, may be similar to the cross-sectional area of forming mandrel 114 along the cut line. In this configuration, interior surface 1508 of braided portion 1400 may therefore correspond to mandrel surface 1502 of forming mandrel 114. That is, as braided portion 1400 is formed, the interior void of braided portion 1400 corresponds to the surface of forming mandrel 114.

In some embodiments, the cross-sectional area of a forming mandrel may be varied. In some embodiments, the cross-sectional area may be large. By utilizing a large cross-sectional area of a forming mandrel, the braided portion that is formed along the forming mandrel may also have a large cross-sectional area. In other embodiments, a forming mandrel with a smaller cross-sectional area may be utilized. A smaller braided portion may be formed over a smaller forming mandrel than a larger forming mandrel.

In some embodiments, the cross-sectional area of a forming mandrel may vary along forming mandrel 114. For example, in some embodiments, the cross section of forward end 1202 may be smaller than the cross section of rearward end 1204. By utilizing a smaller cross-sectional area within ring 108 and a larger cross-sectional area extending away from ring 108, the braided portion may expand as it is pulled from along the forming mandrel from the smaller cross-sectional area to the larger cross-sectional area. This configuration may allow for a tight or accurate fit of the braided portion around the forming mandrel. Additionally, by utilizing a forming mandrel, the braided portion may remain untangled and organized as the braided portion is pulled over the forming mandrel.

Figure 16:
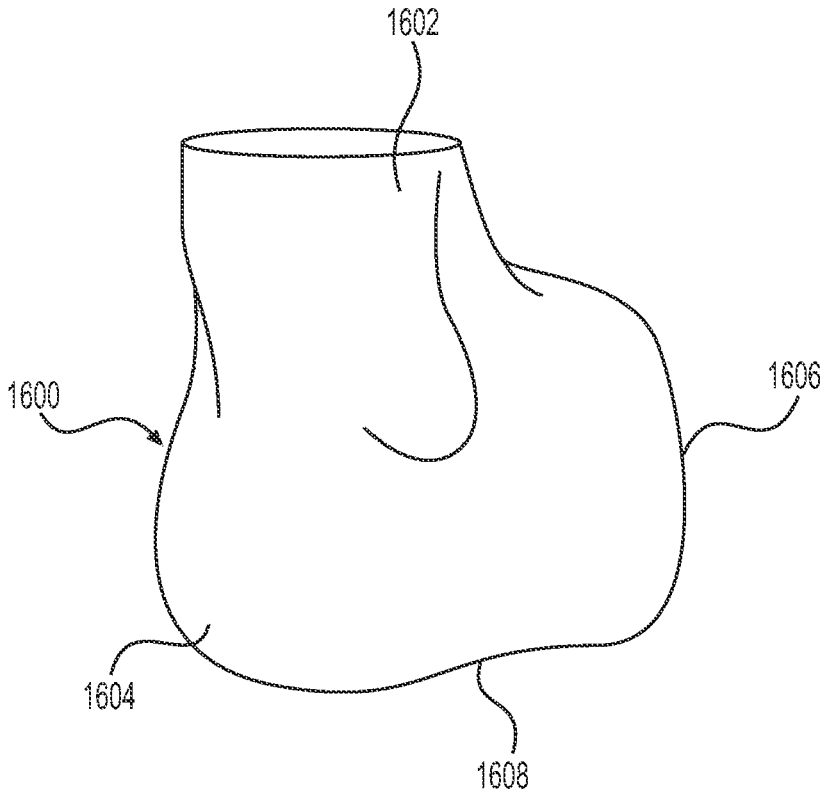
FIG. 16 is a schematic view of an alternate embodiment of a forming mandrel.

Referring to FIGS. 16-19, an alternate embodiment of a forming mandrel is shown. Referring to FIG. 16, forming mandrel 1600 is depicted. In some embodiments, forming mandrel 1600 may be formed in a shape similar to that of a last. In other embodiments, various shapes, sizes, and designs may be used to form a forming mandrel. For example, in some embodiments, a forming mandrel may be utilized in the formation of an upper of an article of footwear; however, the forming mandrel may not be in the shape of a foot or last. In other embodiments, such as the embodiment disclosed in FIGS. 16-19, a forming mandrel may be shaped and sized similarly to a portion of a foot or last. In other embodiments, a forming mandrel may be formed to be the shape and size of an entire last.

In some embodiments, forming mandrel 1600 may be similar in shape to a heel portion of a last. As depicted, forming mandrel 1600 may include a heel end 1604 and a midfoot end 1606. Heel end 1604 may correspond in shape and size to a heel portion of a foot. Midfoot end 1606 may correspond in shape and size to a midfoot area of a foot. Lower end 1608 may correspond to the bottom of a foot. Forming mandrel 1600 may have an ankle portion 1602. In some embodiments, ankle portion 1602 may be shaped in a similar manner to an ankle opening or may be formed to fill the same volume of an ankle opening of an article of footwear. In other embodiments, ankle portion 1602 may be formed in a similar manner to a portion of a last incorporating an ankle portion.

Figure 17:
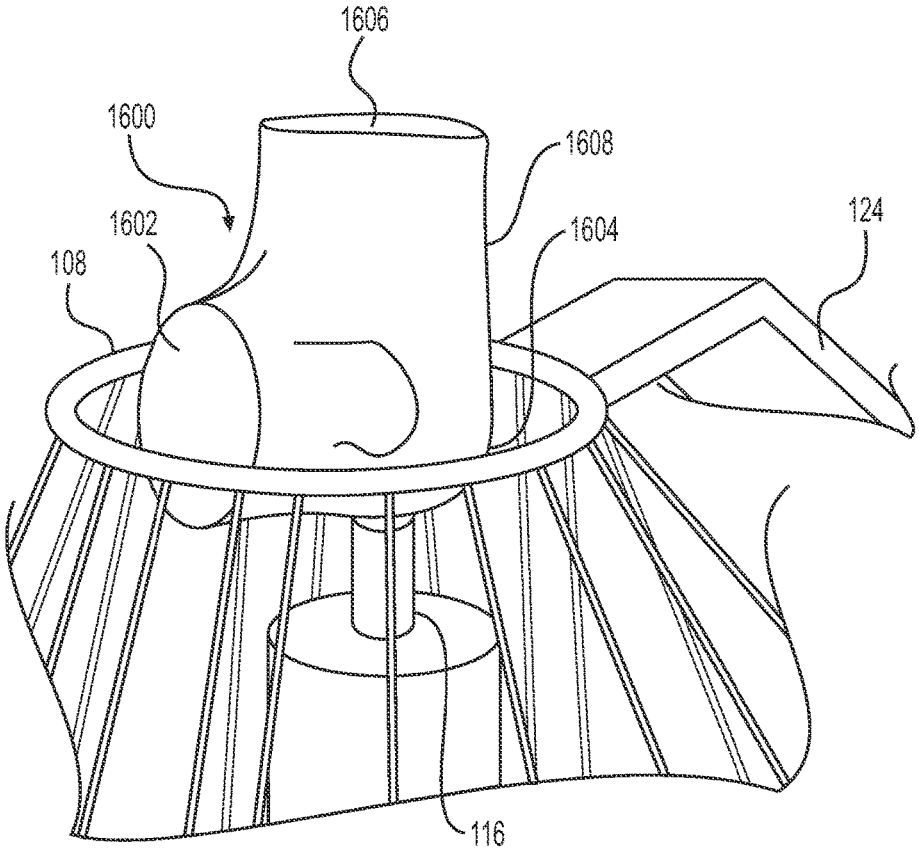
FIG. 17 is a schematic view of an alternate embodiment of a forming mandrel mounted on a braiding machine.

In some embodiments, forming mandrels may be mounted on braiding machine 100. As shown in FIG. 17, heel end 1604 is mounted facing ring 108. In other embodiments, midfoot end 1606 may be mounted facing ring 108. In still further embodiments, ankle portion 1602 may be mounted facing ring 108. By placing or orientating forming mandrel 1600 in different orientations with respect to braiding machine 100, the shape of the braided portion formed around and along forming mandrel 1600 may be altered. For example, by locating a portion of forming mandrel 1600 that has a large cross-sectional area within the horizontal plane encompassing ring 108, a braided structure may be formed that encompasses a large cross-sectional area.

The cross-sectional area of a forming mandrel may be varied. In some embodiments, the cross-sectional area may be small. A small cross-sectional area may be used to form smaller articles of footwear. In other embodiments, a small cross-sectional area may be used to form a braided article that fits tightly around a wearer. In other embodiments, a large cross-sectional area may be used. A large cross-sectional area may be used to form larger articles of footwear. Additionally, a large cross-sectional area may be used to form articles of footwear that have a looser fit when worn.

Figure 18:
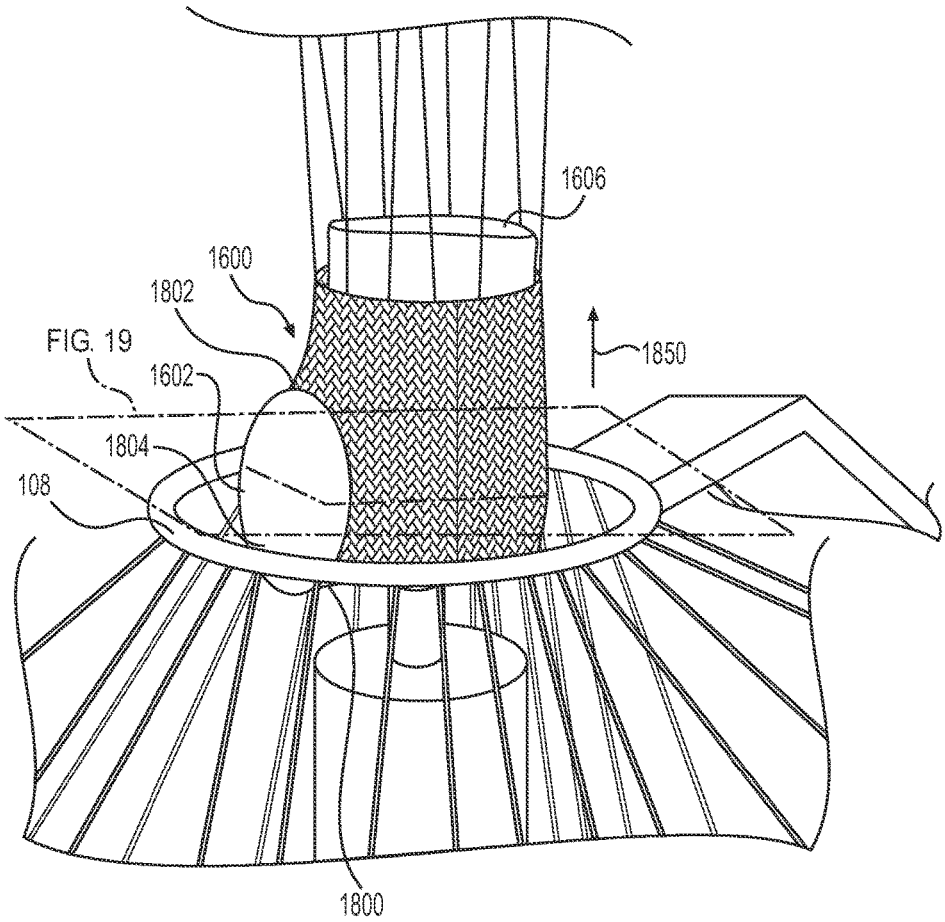
FIG. 18 is a schematic view of an alternate embodiment of a braided portion extending over the forming mandrel.

Referring to FIG. 18, a braided portion is formed along and around forming mandrel 1600. As shown, braided portion 1800 extends along forming mandrel 1600. Braided portion 1800 may include an opening that is associated with the location of ankle portion 1602. In some embodiments, an ankle opening may be formed within braided portion 1800 that generally aligns with the shape of ankle portion 1602. In other embodiments, an ankle opening may be formed that is larger than ankle portion 1602. In still further embodiments, a braided portion may be formed that does not include an ankle opening.

Figure 19:
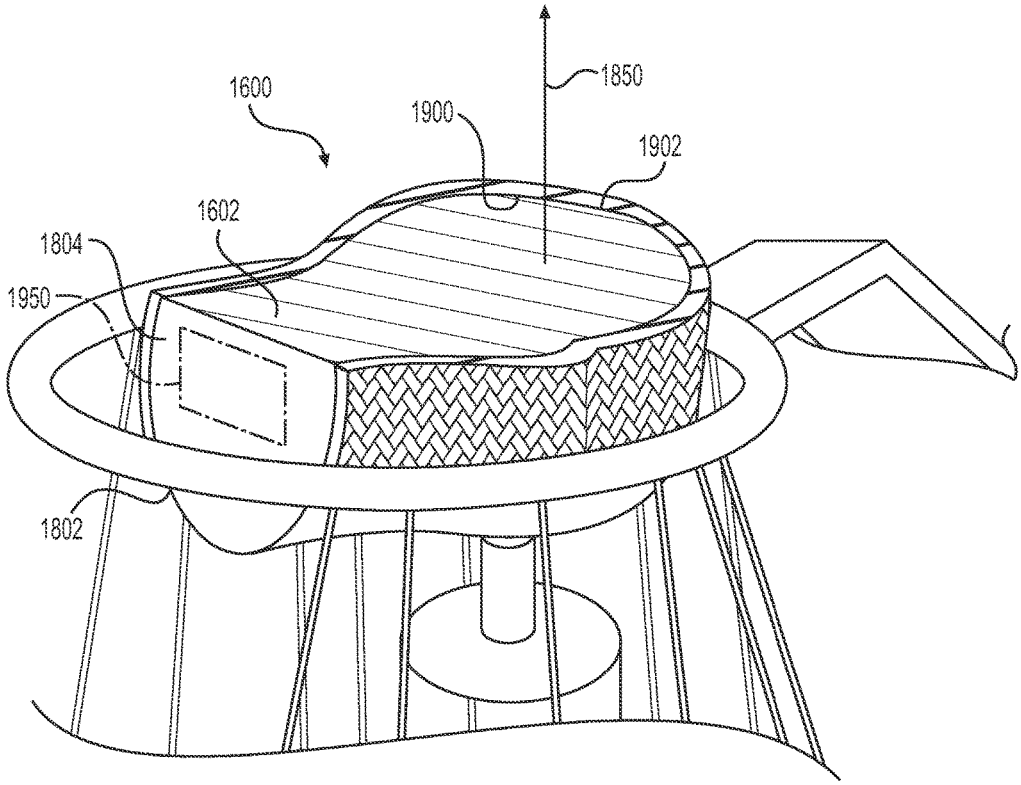
FIG. 19 is an isometric cross-sectional view of the forming mandrel and the braided portion.

In some embodiments, the forming mandrel may not be covered or overbraided in an area that is within a plane that is along or parallel to the braiding direction. Additionally, the forming mandrel may not be covered or overbraided in a plane or surface that is located along ankle portion surface 1804. As shown in FIGS. 18 and 19, the opening of braided portion 1800 along ankle portion surface 1804 is parallel to braiding direction 1850. That is, the opening may be formed in a vertical plane along braided portion 1800. In this detailed description, a vertical plane incorporates the vertical axis. Braiding direction, as used in this Detailed Description is used to describe the direction in which the braided portion extends away from the braiding machine. In FIG. 18, for example, braiding direction 1850 extends vertically away from braiding machine 100.

Generally, braiding machines may form openings that are perpendicular to the braiding direction on either end of a braided structure. That is, the openings generally extend in an area occupied by ring 108. In this embodiment, the openings are located in the horizontal plane, or the plane in which ring 108 is located. Additionally, radial braiding machines or non-jacquard machines may not form additional openings that are parallel to the braiding direction. Lace braiding machines, however, may be programmed to form openings parallel to the braiding direction. For example, a lace braiding machine may form an opening in a vertical plane or a plane that is perpendicular to the plane in which ring 108 is located, within a braided portion. Further, lace braiding machines may be programmed to close openings, such as previously discussed with reference to heel edge 650 and forefoot edge 652.

As shown, braided portion 1800 may be formed vertically and parallel with braiding direction 1850. As braiding machine 100 forms a braided portion, the braided portion extends vertically. The initial braided portion may form an opening in the horizontal plane, such as the opening at the end of a tube. Upon completion of a braided structure, another opening may be formed in the horizontal plane. These openings are formed perpendicular to the braiding direction and are part of the manufacturing process. Additionally, the openings are parallel to the horizontal plane in which ring 108 is located. Heel end 1604 (not visible) and midfoot end 1606 are oriented perpendicular to the braiding direction or in the horizontal plane. In this embodiment, therefore, heel end 1604 and midfoot end 1606 may not be completely overbraided without additional modification to the braiding machine.

In some embodiments, braided portion 1800 may include an opening parallel with the braiding direction or within a vertical plane. In some embodiments, the opening may correspond to an ankle opening. An opening is used to define a space within the braided structure that is formed as a deliberate altering of the braided structure. For example, the spaces between strands of a non-jacquard braided structure may not be considered openings for purposes of this Detailed Description. As shown in FIG. 18, ankle opening 1802 may be formed parallel to the braiding direction.

Ankle opening 1802 may be formed of various shapes and sizes. In some embodiments, ankle opening 1802 may be largely circular. In other embodiments, ankle opening 1802 may be irregularly shaped. Additionally, in some embodiments, ankle opening 1802 may correspond to the shape of ankle portion 1602. That is, in some embodiments, braided portion 1800 may extend to the end of ankle portion 1602. In this embodiment, however, braided portion 1800 may not cover ankle portion surface 1804. In other embodiments, ankle opening 1802 may extend below ankle portion surface 1804. That is, in some embodiments, ankle opening 1802 may extend toward lower end 1608 (see FIG. 17).

Referring to FIG. 19, a cross-sectional view of braided portion 1800 of FIG. 18 and forming mandrel 1600 is depicted. As shown, braided portion 1800 surrounds the outer periphery of forming mandrel 1600. Braided portion 1800, however, does not completely envelop forming mandrel 1600. Rather, braided portion 1800 forms a tube that extends around forming mandrel 1600. For example, heel end 1604 and midfoot end 1606 (not visible) may not be covered or enveloped by braided portion 1800 because heel end 1604 and midfoot end 1606 extend along the horizontal plane of ring 108. Additionally, ankle opening 1802 is formed along a vertical plane, for example, vertical plane 1950, in the braiding direction of braided portion 1800. Ankle opening 1802, therefore, does not cover ankle portion surface 1804, which is parallel to the braiding direction and located along vertical plane 1950.

In some embodiments, the interior surface of a braided portion may correspond to the surface of the forming mandrel. As depicted, interior surface 1900 largely corresponds to mandrel surface 1902. In other embodiments, interior surface 1900 of a braided portion may loosely correspond to mandrel surface 1902. In still further embodiments, interior surface 1900 may not correspond to mandrel surface 1902. In such embodiments, forming mandrel 1600 may assist in guiding braided portion 1800 such that braided portion 1800 does not entangle with itself or other pieces or components of braiding machine 100.

Lace Braiding Configuration

Generally, the types of braiding machines include lace braiding machines, axial braiding machines, and radial braiding machines. For the purpose of this Detailed Description, radial braiding machines and axial braiding machines include intermeshed horn gears. These horn gears include "horns" that are openings or slots within the horn gears. Each of the horns may be configured to accept a carrier or carriage. In this configuration, therefore, axial braiding machines and radial braiding machines are configured to form non-jacquard braided structures.

A carriage is a vessel that may be passed between various horn gears. The carriages may be placed within various horns in the horn gears of the radial braiding machine. As a first horn gear rotates, the other horn gears rotate as well because each of the horn gears is intermeshed with one another. As a horn gear rotates, the horns within each horn gear pass by one another at precise points. For example, a horn from a first horn gear passes by a horn from an adjacent second horn gear. In some embodiments, a horn of a horn gear may include a carriage. As the horn gear rotates, the adjacent horn gear may include an open horn. The carriage may pass to the open horn. The carriage may pass around the braiding machine from horn gear to horn gear, eventually traversing around the braiding machine. An example of a radial braiding machine and components of a radial braiding machine are discussed in Richardson, U.S. Pat. No. 5,257,571, granted Nov. 2, 1993, entitled "Maypole Braider Having a Three Under and Three Over Braiding Path," the entirety of which is hereby incorporated by reference.

Additionally, each carriage may hold a spool. The spools include a thread, strand, yarn, or a similar material that may be braided together. The thread from the spools extends toward a braiding point. In some embodiments, the braiding point may be located in the center of the braiding machine. In some embodiments, the thread from the spools may be under tension such that the thread from the spools are generally aligned and may remain untangled.

Figure 20:
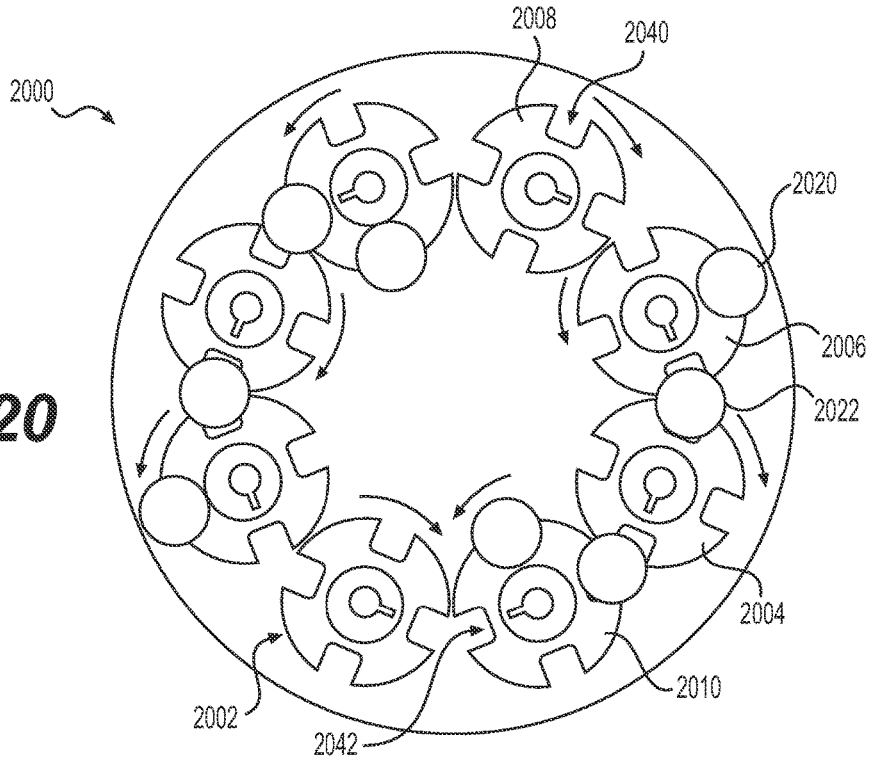
FIG. 20 is a top view of a schematic of an axial braiding machine.

As each carriage and spool combination is passed along the horn gears, the thread from each of the spools may intertwine. Referring to FIG. 20, a top schematic view of radial braiding machine 2000 is depicted. Radial braiding machine 2000 includes a plurality of horn gears 2002. Each of the plurality of horn gears 2002 includes an arrow indicating the direction in which the horn gear turns. For example, horn gear 2004 rotates in a clockwise manner. In contrast, horn gear 2006 rotates in a counterclockwise manner. As depicted, each of the horn gears rotates in the opposite direction of the adjacent horn gear. This is because the horn gears are intermeshed with one another and, therefore, radial braiding machine 2000 is considered to be a fully non-jacquard machine.

Due to the intermeshing of the horn gears, each carriage and spool may take particular paths. For example, carriage 2020, including a spool, rotates counterclockwise on horn gear 2006. As horn gear 2006 rotates counterclockwise, horn gear 2008 may rotate clockwise. While each of the horn gears rotates, horn 2040 may align with carriage 2020. Because horn 2040 is open, that is, horn 2040 is not occupied by another carriage, horn 2040 may accept carriage 2020. Carriage 2020 may continue on horn gear 2008 and rotate in a clockwise manner until carriage 2020 aligns with another open horn.

Additionally, other carriages may rotate in a different direction. For example, carriage 2022, including a spool, may rotate clockwise on horn gear 2004. Carriage 2022 may eventually align with a horn 2042 of horn gear 2010 that is not occupied by a carriage. As carriage 2022 aligns with horn 2042, carriage 2022 may pass onto horn gear 2010. Once carriage 2022 is on horn gear 2010, carriage 2022 may rotate counterclockwise on horn gear 2010. Carriage 2022 may continue on horn gear 2010 until carriage 2022 aligns with another open horn on an adjacent horn gear.

As the carriages extend around radial braiding machine 2000, the thread from the spools located within the carriages may intertwine with one another. As the thread intertwines, a non-jacquard braided structure may be formed.

Figure 21:
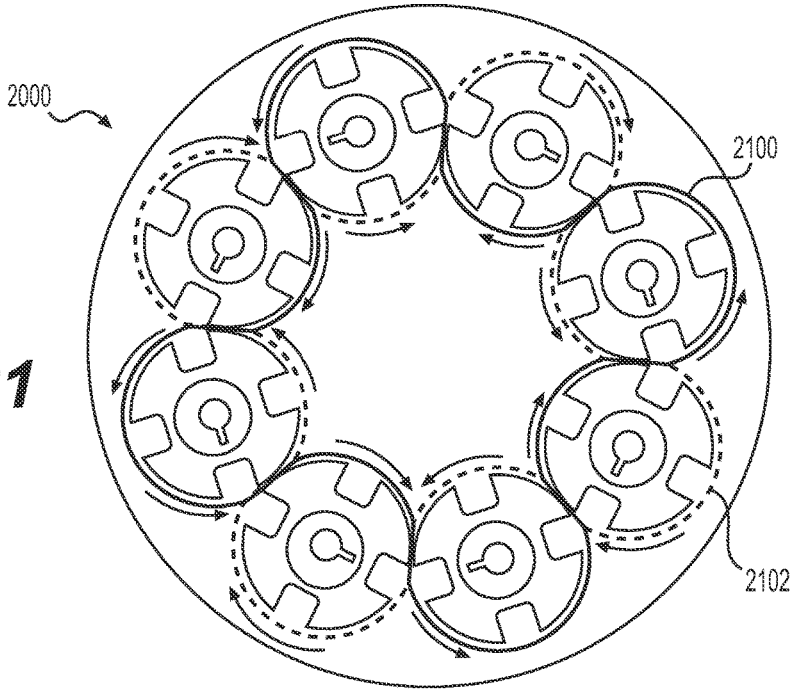
FIG. 21 is a schematic of an axial braiding machine depicting the path of spools.

Referring to FIG. 21, the general path of a carriage on radial braiding machine 2000 is depicted. Path 2100 indicates the path that carriage 2020 may take. Path 2102 indicates the path that carriage 2022 may take. Although path 2100 generally follows a counterclockwise rotation, it should be recognized that carriage 2020 rotates locally in a clockwise and counterclockwise manner as carriage 2020 passes from horn gear to horn gear. Additionally, path 2102 generally follows a clockwise rotation; however, carriage 2022 rotates locally in a clockwise and counterclockwise manner as carriage 2022 passes between the horn gears. As shown, path 2102 and path 2100 are continuous around radial braiding machine 2000. That is, path 2102 and path 2100 do not change overall direction around radial braiding machine 2000.

In the configuration as shown, radial braiding machine 2000 may not be configured to form intricate and customized designs of braided structures. Due to the construction of radial braiding machine 2000, each carriage passes between plurality of horn gears 2002 in largely the same path. For example, carriage 2022 rotates clockwise around radial braiding machine 2000 along path 2102. Carriage 2022 is generally fixed in this path. For example, carriage 2022 generally cannot transfer onto path 2100.

Additionally, the interaction and intertwining of strands on each of the carriages is generally fixed from the beginning of the braiding cycle. That is, the placement of carriages in the beginning of the braiding cycle may determine the formation of the braided structure formed by radial braiding machine 2000. For example, as soon as the carriages are placed in specific horns within the horn gears, the pattern and interaction of the carriages is not altered unless radial braiding machine 2000 is stopped and the carriages are rearranged. This means that the braided portion formed from a radial braiding machine 2000 may form a repeating pattern throughout the braided portion that may be referred to as a non-jacquard braided portion. Additionally, this configuration does not allow for specific designs or shapes to be formed within a braided portion.

With reference to radial braiding machine 2000, in some embodiments, the carriages placed within the horns or slots of plurality of horn gears 2002 may be placed in predetermined locations. That is, the carriages may be placed so that as the horn gears of radial braiding machine 2000 rotate, the carriages will not interfere with one another. In some embodiments, radial braiding machine 2000 may be damaged if carriages are not preplaced in a particular arrangement. As the carriages extend from one horn gear to another, an open horn must be available at the junction of adjacent horn gears for the carriages to pass from one horn gear to another. If the horn of a horn gear is not open, the attempted transfer of carriages may cause damage to the radial braiding machine. For example, as shown in FIG. 20, horn 2040 is not occupied by a carriage. If horn 2040 were to be occupied by a carriage in the current configuration, carriage 2020 would interfere with that carriage. In such a configuration, radial braiding machine 2000 may be damaged due to the interference. The carriages may be particularly placed within horns such that interference between carriages may be avoided.

Figure 22:
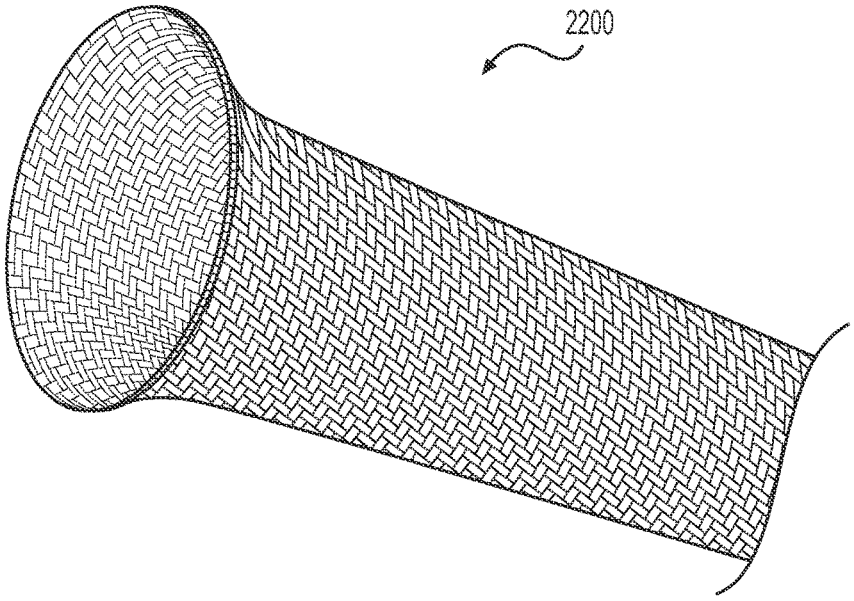
FIG. 22 is an embodiment of a tube formed using an axial braiding machine.

Referring to FIG. 22, a configuration of a braided structure formed from radial braiding machine 2000 is depicted. As shown braided portion 2200 is formed in a largely tubular shape. The same non-jacquard braid structure is depicted throughout the length of braided portion 2200. Additionally, there are no holes, openings, or designs within the side of braided portion 2200 that are parallel to the braiding direction. Rather, braided portion 2200 depicts an opening at either end of braided portion 2200. That is, the openings of braided portion 2200 are only depicted in an area that is perpendicular to the braiding direction of radial braiding machine 2000.

Referring to FIG. 23, a cutaway portion of braiding machine 100 is depicted. As shown, a portion of track 122 has been removed for ease of description. Additionally, plurality of spools 102 are shown located in gaps 104 between rotor metals 106. Gaps 104 may be the area or space between adjacent rotor metals 106. As discussed previously, rotor metals 106 may rotate and press or slide the spools to an adjacent gap.

In some embodiments, rotor metals 106 may be turned by motors. In some embodiments, rotor metals 106 may each be controlled by a motor. In other embodiments, rotor metals 106 may be controlled by various gears and clutches. In still further embodiments, rotor metals 106 may be controlled by another method.

Figure 24:
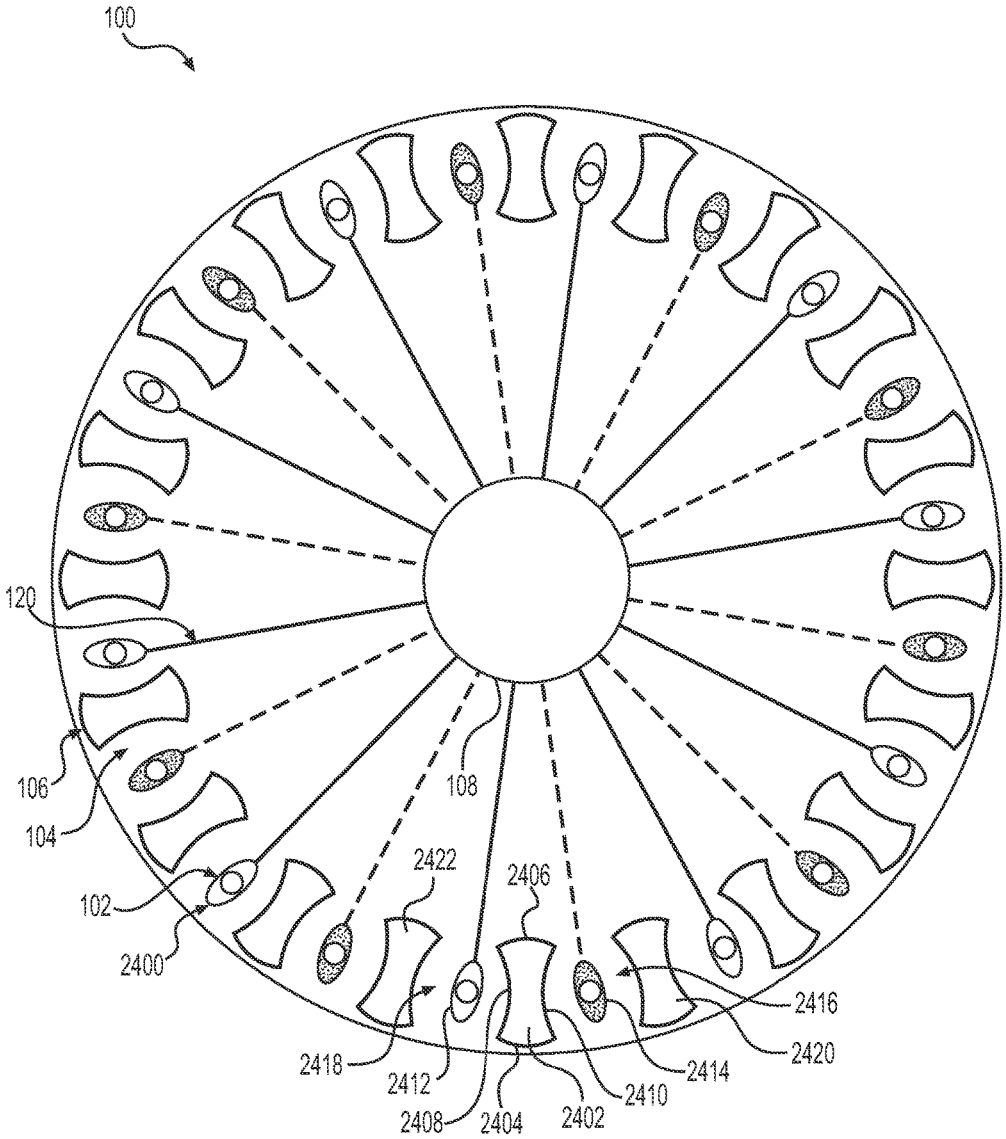
FIG. 24 is a top view of an embodiment of a braiding machine.

Referring to FIG. 24, a schematic of a top view of braiding machine 100 is depicted. Braiding machine 100 includes rotor metals 106 and a plurality of carriages 2400. Each of the plurality of carriages 2400 may include spools that include thread. As depicted, a plurality of spools 102 is arranged within the plurality of carriages 2400. Additionally, threads 120 extend from each of the plurality of spools 102.

In some embodiments, the size of braiding machine 100 may be varied. In some embodiments, braiding machine 100 may be able to accept 96 carriages. In other embodiments, braiding machine 100 may be able to accept 144 carriages. In still further embodiments, braiding machine 100 may be able to accept 288 carriages or more. In further embodiments, braiding machine 100 may be able to accept between about 96 carriages and about 432 carriages. In still further embodiments, the number of carriages may be less than 96 carriages or over 432 carriages. By varying the number of carriages and spools within a braiding machine, the density of the braided structure as well as the size of the braided component may be altered. For example, a braided structure formed with 432 spools may be denser or include more coverage than a braided structure formed with fewer spools. Additionally, by increasing the number of spools, a larger-sized objected may be overbraided.

In some embodiments, rotor metals 106 may have various shapes. Each rotor metal may be evenly spaced from one another and is formed in the same shape. Referring particularly to rotor metal 2402, in some embodiments, an upper and a lower end may include convex portions. As shown, rotor metal 2402 includes first convex edge 2404 and second convex edge 2406. As shown, first convex edge 2404 and second convex edge 2406 extend away from a central portion of rotor metal 2402. Additionally, first convex edge 2404 is located on an opposite side of rotor metal 2402 from second convex edge 2406. In this position, second convex edge 2406 is oriented toward ring 108 while first convex edge 2404 is oriented toward an outer perimeter of braiding machine 100. braiding machine 100 In this configuration, rotor metal 2402 is in a steady state or starting position. The orientation of first convex edge 2404 and second convex edge 2406 may change during use of braiding machine 100.

In some embodiments, the sides of the rotor metals may include concave portions. As depicted, rotor metal 2402 includes first concave edge 2408 and second concave edge 2410. First concave edge 2408 and second concave edge 2410 may extend between first convex edge 2404 and second convex edge 2406. In such a configuration, rotor metal 2402 may have a shape that is similar to a bowtie. In other embodiments, rotor metals 106 may have different or varying shapes.

The orientation of each carriage may vary during the use of braiding machine 100. In this configuration, first concave edge 2408 is located adjacent to carriage 2412. Second concave edge 2410 is located adjacent to carriage 2414. As rotor metal 2402 rotates, carriage 2414 may interact with second concave edge 2410 and carriage 2412 may interact with first concave edge 2408. By interacting with carriage 2414, carriage 2414 may be rotated away from gap 2416 located between rotor metal 2402 and rotor metal 2420. Additionally, carriage 2412 may be rotated away from gap 2418 located between rotor metal 2402 and rotor metal 2422.

As shown, each rotor metal of rotor metals 106 is arranged along a perimeter portion of braiding machine 100.

The even spacing of rotor metals 106 forms even and consistent gaps 104 between each of the rotor metals 106 along the perimeter of braiding machine 100. Gaps 104 may be occupied by plurality of carriages 2400. In other embodiments, a portion of gaps 104 may be unoccupied or empty.

Figure 25:
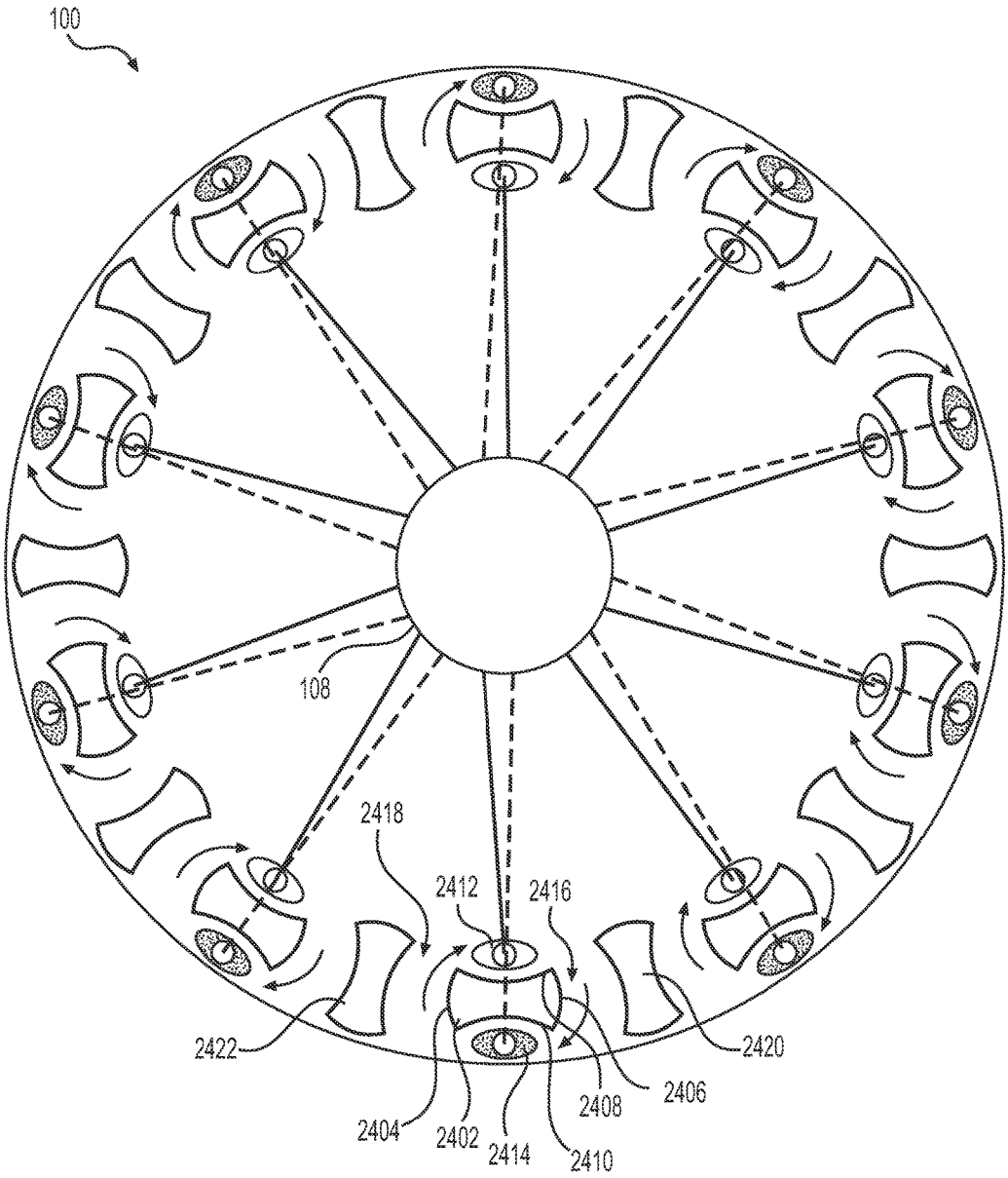
FIG. 25 is a top view of the process of rotating rotor metals of a braiding machine.

In contrast to radial braiding machines or fully non-jacquard machines, in a lace braiding machine, each rotor metal is not intermeshed with the adjacent rotor metal. Rather, each rotor metal may be selectively independently movable at opportune times. That is, each rotor metal may rotate independently from other rotor metals of braiding machine 100 when there is clearance for a rotor metal to rotate. Referring to FIG. 25, every other rotor metal is depicted as rotating approximately 90 degrees in a clockwise direction from a first position to a second position. In contrast to braiding with a radial braiding machine, every rotor metal does not rotate. In fact, some rotor metals are not permitted to rotate. For example, rotor metal 2402 rotates from a first position approximately ninety degrees clockwise to a second position. Adjacent rotor metal 2420, however, may not be permitted to rotate as adjacent rotor metal 2420 may collide with rotor metal 2402 in the current position.

In some embodiments, the rotation of a rotor metal may assist in rotating carriages along the perimeter of braiding machine 100. Referring to rotor metal 2402, second concave edge 2410 may press against carriage 2414. As rotor metal 2402 contacts carriage 2414, rotor metal 2402 may press or push carriage 2414 in a clockwise direction. As shown, carriage 2414 is located between second concave edge 2410 and the perimeter portion of braiding machine 100. Additionally, carriage 2412 may rotate clockwise as well. First concave edge 2408 may press against carriage 2412 and push or force carriage 2412 to rotate clockwise. In this configuration, carriage 2412 may be located between rotor metal 2402 and ring 108.

In some embodiments, portions of rotor metals may enter into gaps located between each of the rotor metals. In some embodiments, the convex portions of a rotor metal may be located within the gaps between rotor metals. As shown in FIG. 25, second convex edge 2406 may be partially located within gap 2416. Additionally, first convex edge 2404 may be partially located within gap 2418. In this configuration, therefore, rotor metal 2422 and rotor metal 2420 may be restricted from rotating because each of the rotor metal may contact rotor metal 2404.

Figure 26:
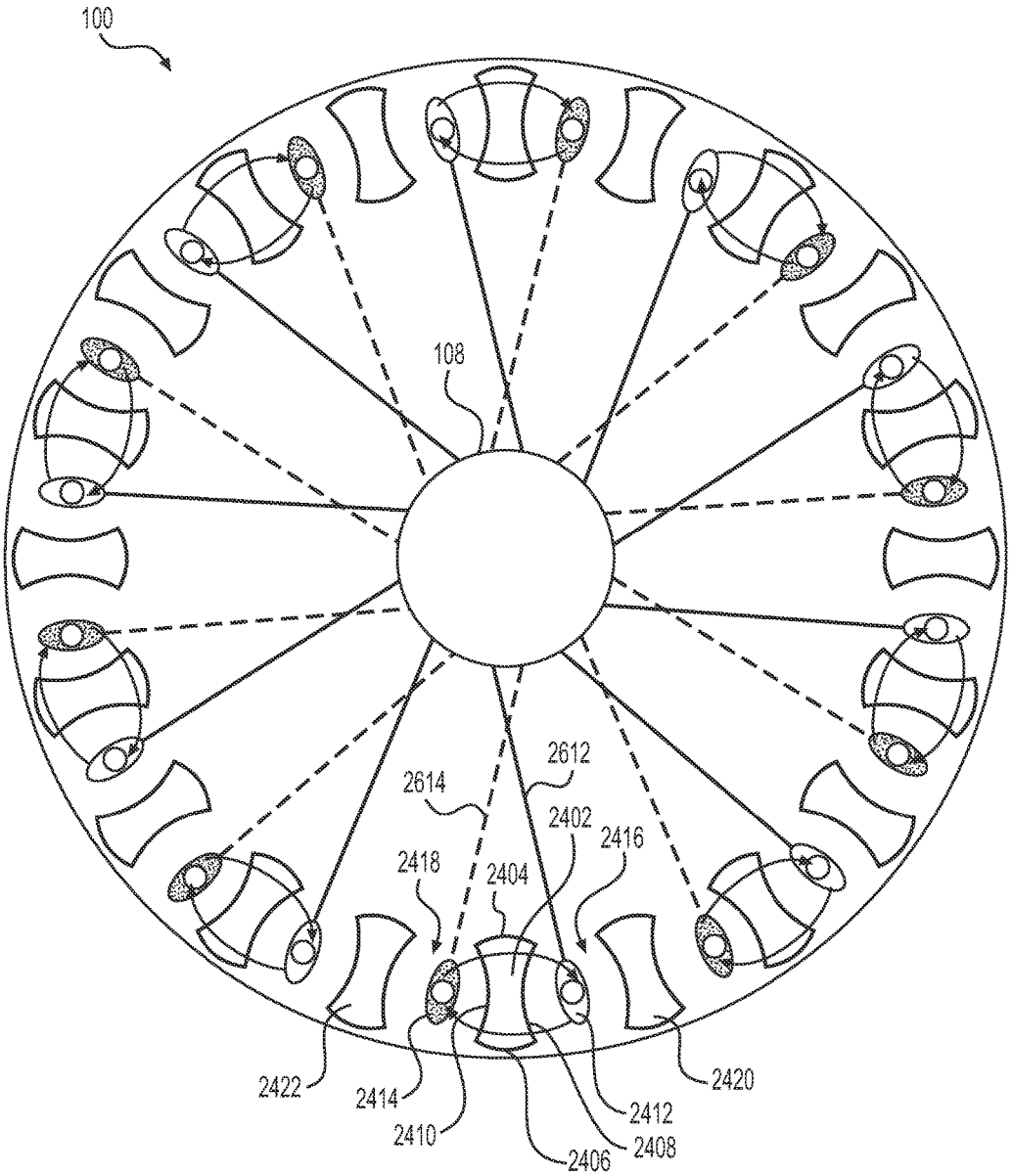
FIG. 26 is a top view of the process of rotor metals completing a half rotation in a lace braiding machine.

Referring to FIG. 26, half of the rotor metals have complete a 180 degree rotation. For example, rotor metal 2402 has completed a 180-degree rotation. In this configuration, second convex edge 2406 now faces the perimeter of braiding machine 100. First convex edge 2404 now faces ring 108. Further, carriage 2412 now occupies gap 2416. Additionally, carriage 2414 now occupies gap 2418. In this configuration, carriage 2414 and carriage 2412 have exchanged places from the configuration depicted in FIG. 24.

In some embodiments, as the carriages pass by one another, the strand or thread from the spools located within the carriages may intertwine. As shown in FIG. 26, strand 2612 from the spool of carriage 2412 may intertwine with strand 2614 from the spool of carriage 2414. Additionally, the strands from other carriages may also intertwine. In this manner, a braided structure may be formed through the interaction and intertwining of various strands from the spools located within the carriages of braiding machine 100.

In some embodiments, the number of carriages and spools within braiding machine 100 may be varied. For example, in some embodiments, many gaps 104 may remain unoccupied. By not filling a gap with a carriage and spool, different designs and braided structures may be formed. In some embodiments, by not including spools in certain locations, holes or openings may be formed in a braided structure or component.

In some embodiments, each rotor metal may rotate at opportune times. For example, in the configuration shown in FIG. 26, rotor metal 2422 may rotate. While rotor metal 2422 begins to rotate, rotor metal 2402 may not rotate so as to avoid a collision between rotor metal 2422 and rotor metal 2402. When rotor metal 2422 rotates, rotor metal 2422 may press against carriage 2414 and move carriage 2414 in the same manner as rotor metal 2402 moved carriage 2414. Strand 2614 may then interact and intertwine with a different strand and form a different braided design. Other carriages may similarly be acted upon to form various braided elements within a braided structure.

In some embodiments, some carriages may individually rotate counterclockwise. In some embodiments, rotor metal 2422 and rotor metal 2420 may rotate counterclockwise. Additionally, every other rotor metal may also rotate counterclockwise. In such a configuration, a braided structure may be formed that is similar in appearance to a braided structure formed on radial braiding machine 2000. This type of motion may be considered a non-jacquard motion. A non-jacquard motion may form a non-jacquard braid structure. For example, in some configurations, every other rotor metal from rotor metal 2402 may be configured to rotate clockwise at opportune times. Every other rotor metal from rotor metal 2422 may be configured to rotate counterclockwise at opportune times. In this configuration, as rotor metal 2422 rotates counterclockwise, rotor metal 2422 may locally rotate carriage 2414 counterclockwise. Additionally, as rotor metal 2420 rotates counterclockwise, rotor metal 2420 may contact carriage 2412 and locally rotate carriage 2412 counterclockwise. In such a configuration, however, carriage 2414 may be rotating clockwise around the perimeter of braiding machine 100. Carriage 2412 may be rotating counterclockwise around the perimeter of braiding machine 100. In this manner, carriage 2412 may be rotating in a path similar to path 2100 of FIG. 21. Additionally, carriage 2414 may be rotating in a path similar to path 2102 of FIG. 21. As such, braiding machine 100 may be configured to mimic or recreate the non-jacquard motion of radial braiding machine 2000 and form non-jacquard structures within a braided portion. In such configurations, braiding machine 100 may be configured to form braided structures that are similar to those braided structures formed on radial braiding machine 2000.

Although braiding machine 100 may be configured to mimic the motion of a radial braiding machine and thereby form non-jacquard portions, it should be recognized that braiding machine 100 is not forced to mimic the motion of radial braiding machine 2000. For example, rotor metals 106 may be configured to rotate both clockwise and counterclockwise. For example, rotor metal 2402 may be configured to rotate both clockwise and counterclockwise. In other embodiments, each rotor metal of rotor metals 106 may be configured to rotate both clockwise and counterclockwise. By rotating clockwise and counterclockwise, braiding machine 100 may be able to form designs and unique braided structures within a braided component that radial braiding machine 2000 may be incapable of forming.

Figure 27:
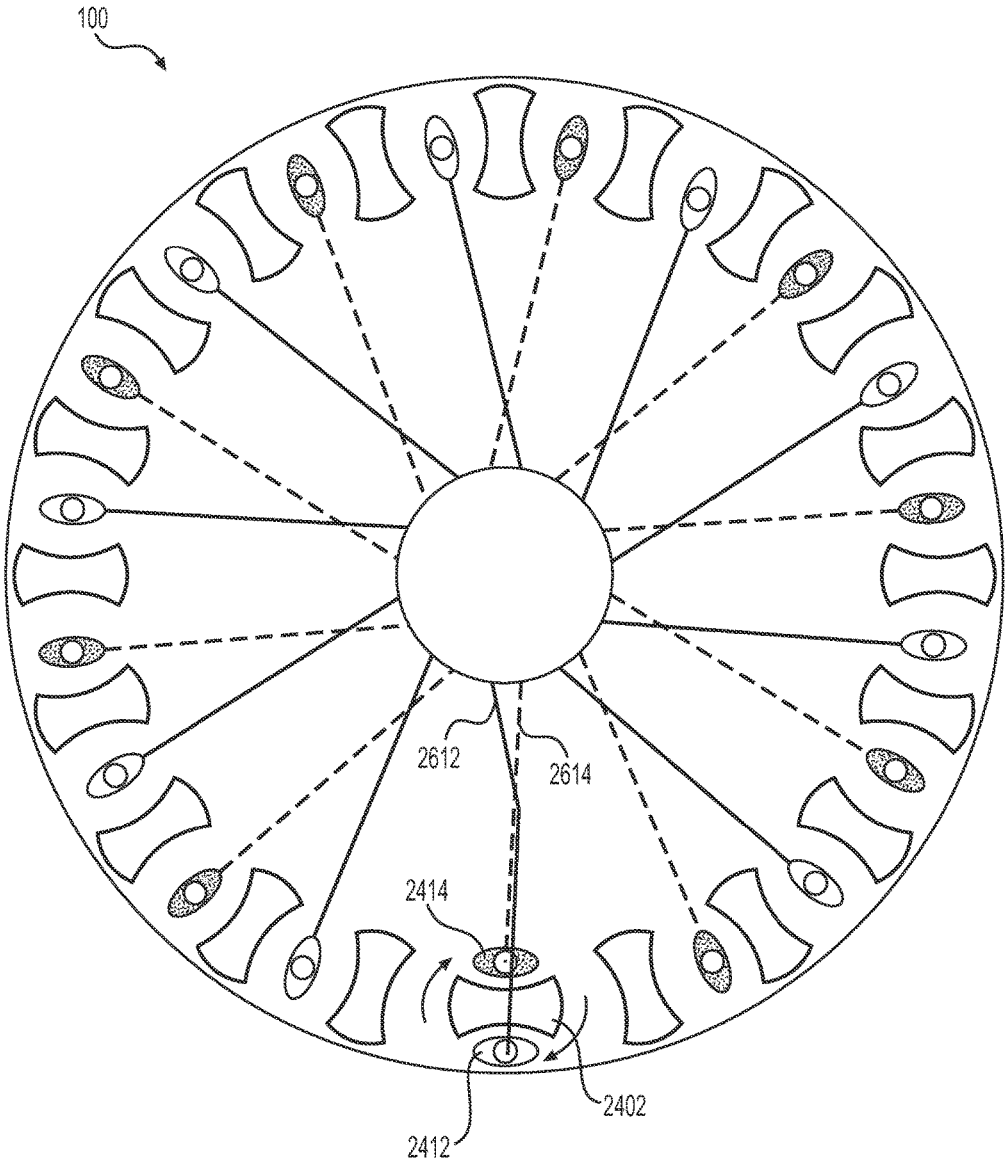
FIG. 27 is a top view of a single rotor metal rotating in a braiding machine.
Figure 28:
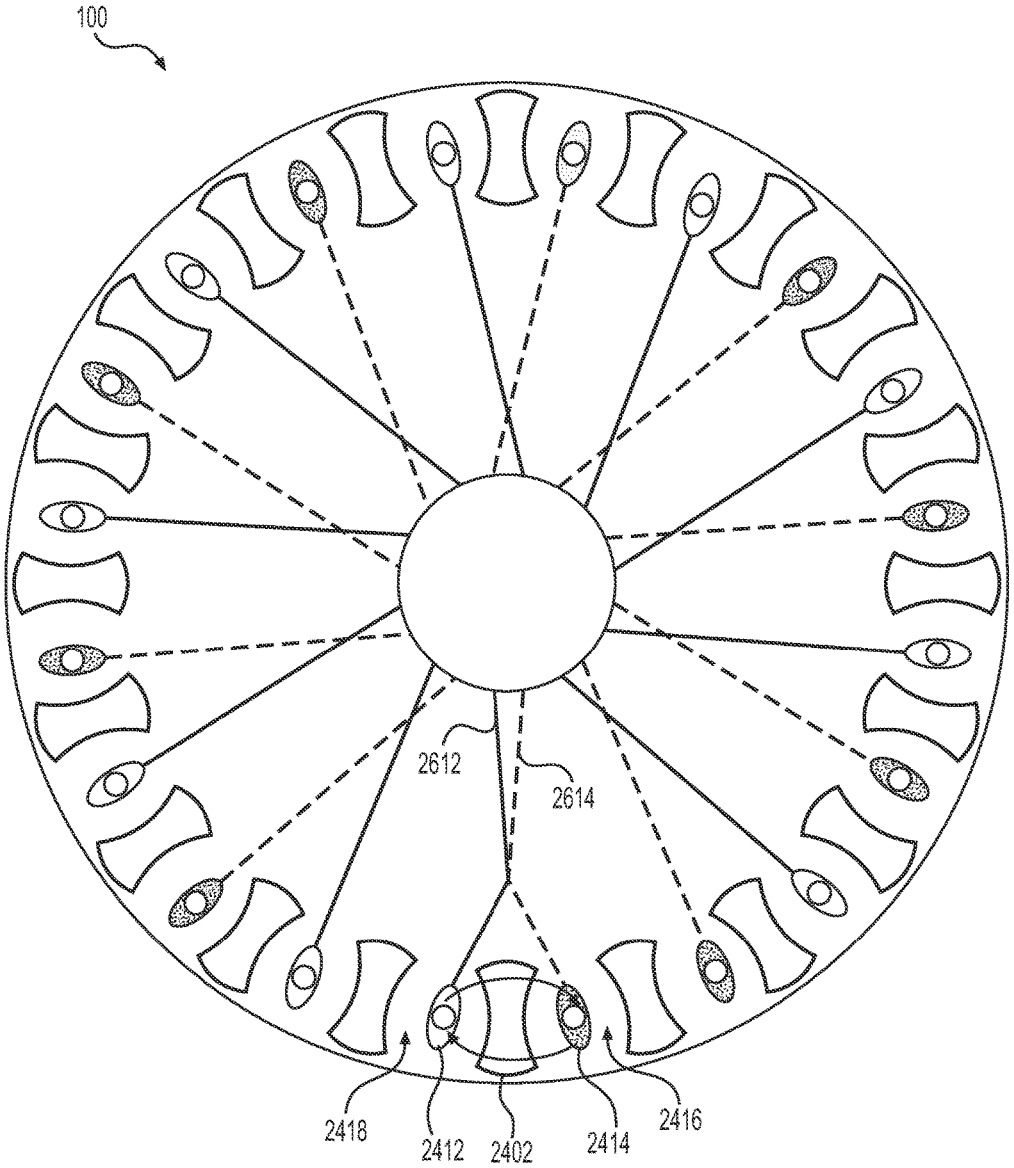
FIG. 28 is a top view of a single rotor metal completing a one half revolution.

Referring to FIGS. 27 and 28, an individual rotor metal may rotate. As shown, rotor metal 2402 rotates clockwise and interacts with carriage 2414 and carriage 2412. Carriage 2414 may be moved to occupy gap 2416. Additionally carriage 2412 may be moved to occupy gap 2418. In this configuration, strand 2612 may twist around strand 2614. In this manner, rotor metal 2402 may assist in forming a jacquard braided structure that may not be formed on radial braiding machine 2000. Additionally, other rotor metals may rotate in a similar manner to form intricate patterns and designs that may not be possible on a radial braiding machine.

Figure 29:
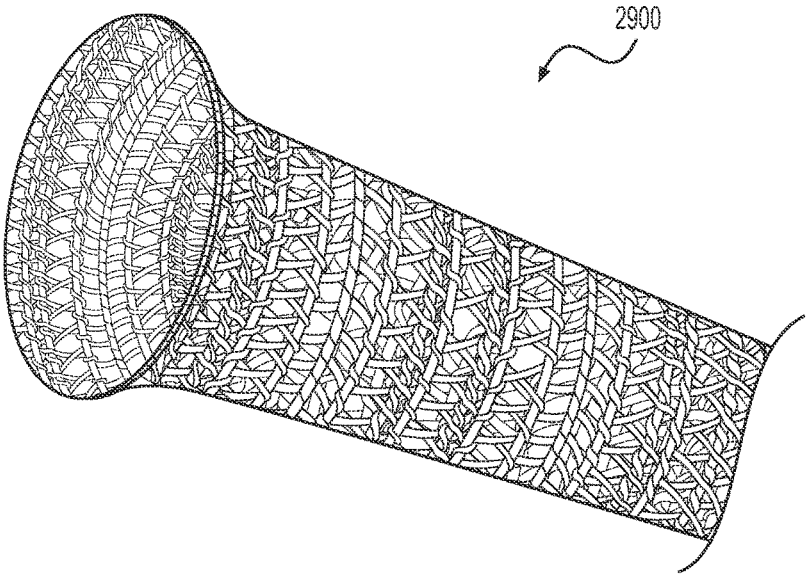
FIG. 29 is a schematic of a tube formed on the braiding machine.

Referring to FIG. 29, an article that is formed using a lace braiding machine is depicted. In contrast to braided portion 2200 of FIG. 22, braided portion 2900 includes an intricate jacquard braided structure. While braided portion 2200 is formed of a consistent and repeating non-jacquard braided structure, braided portion 2900 includes multiple different designs and intricate braided structures. Braided portion 2900 may include openings within braided portion 2900 along the braiding direction as well as tightly braided areas with a high density of strands or thread.

Referring to FIG. 30, an article of footwear that may be formed as a unitary piece using a lace braiding machine is depicted. Article 3000 may include various design features that may be incorporated into article 3000 during the braiding process. In some embodiments, lace aperture 3002, lace aperture 3004, lace aperture 3006 and lace aperture 3008 may be formed during the manufacturing process.

In some embodiments, article 3000 may incorporate areas of high-density braid as well as areas of low-density braid. For example, area 3010 may be formed with a high-density braided configuration. In some embodiments, area 3010 may be a non-jacquard area that is formed during a non-jacquard motion of spools within braiding machine 100. In some embodiments, high-density areas may be located in areas of article 3000 that are likely to experience higher levels of force. For example, in some embodiments, area 3010 may be located adjacent a sole structure. In other embodiments, area 3010 may be located in various areas for design and aesthetic reasons. Additionally, in some embodiments, lower density braid 3012 may be located throughout article 3000. In some embodiments, lower density braid 3012 may be a jacquard area formed during a jacquard motion of spools within braiding machine 100. In some embodiments, lower density braid 3012 may extend between and connect areas of high-density braid or non-jacquard areas. In other embodiments, lower density braid 3012 may be located in areas of article 3000 that may be configured to stretch. In other embodiments, lower density braid 3012 may be placed in areas for aesthetic and design purposes.

In some embodiments, different techniques may be used to form different densities of braided structures. For example, in some embodiments, a jacquard area may have a higher density than a non-jacquard area. As discussed previously, varying rate of rotation of the spools as well as the rate of extension of a braided component may assist in varying the density of the braided component.

In some embodiments, article 3000 may be formed using a seamless braided upper. As discussed previously, braiding machine 100 may be used to form different braided shapes and structures. In some embodiments, the upper of article 3000 may be formed using a lace braiding machine to form a seamless configuration of higher density areas and lower density areas.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A method of forming a braided upper using a braiding machine system comprising a support structure, the method comprising the steps of:

locating a forming mandrel above a ring located at a braiding point of the braiding machine system, wherein the braiding point is located on a first plane of the ring, wherein a first portion of the forming mandrel extends through the braiding point, and wherein a second portion of the forming mandrel is located above the first plane;

securing the forming mandrel to the support structure of the braiding machine system;

braiding a plurality of strands to form a three dimensional braided component, wherein the plurality of strands extend through the ring;

pulling the braided component over the forming mandrel; and inserting a last into the braided component to shape the braided component, wherein the braiding machine system includes a plurality of rotor metals arranged in a track on the support structure, wherein at least one of the plurality of rotor metals is selectively moveable.

2. The method according to claim 1, wherein the braided component includes a first opening, wherein the first opening is located along a second plane that is parallel with a braiding direction during a braiding process.

3. The method according to claim 2, wherein the first opening corresponds to an ankle opening of the upper.

4. The method according to claim 2, wherein a second opening is formed along a third plane that is parallel with the braiding direction during the braiding process, the second plane being different than the third plane.

5. The method according to claim 4, wherein the second opening is a lace aperture.

6. The method according to claim 1, further comprising closing the braided component.

7. The method according to claim 6, wherein the braided component is closed at a first end and a second end.

8. The method according to claim 7, wherein the first end corresponds to a heel portion and the second end corresponds to a forefoot portion.

9. The method according to claim 1, wherein the forming mandrel has a shape of a forefoot portion of a foot.

10. The method according to claim 1, wherein the forming mandrel has a shape of a heel portion of a foot.

11. A method of forming a braided upper using a braiding machine system comprising a support structure, the method comprising:

locating a forming mandrel within a ring located at a braiding point of the braiding machine system, the braiding machine system comprising a plurality of rotor metals arranged in a track on the support structure, wherein at least one of the plurality of rotor metals is selectively moveable, wherein the braiding point is located on a first plane of the ring, wherein a first portion of the forming mandrel extends through the braiding point, and wherein a second portion of the forming mandrel is located above the first plane;

securing the forming mandrel to the support structure of the braiding machine system;

braiding a plurality of strands to form a three dimensional braided component, wherein the plurality of strands extend through the ring of the braiding machine system;

pulling the braided component over the forming mandrel; and inserting a last into the braided component.

12. The method according to claim 11, wherein the braided component conforms to a shape of the forming mandrel.

13. The method according to claim 11, wherein the braiding machine system is a lace braiding machine.

14. The method according to claim 12, wherein an opening is formed during a braiding process of the braided component, wherein the opening is located within the braided component along a plane that is parallel to a braided direction.

15. The method according to claim 12, further comprising forming a first seal at a first end and forming a second seal at a second end of the braided component.

16. The method according to claim 15, wherein the first end corresponds to a heel end and the second end correspond to a forefoot end.

17. The method according to claim 16, wherein when the last is inserted into the braided component, a heel portion of the last abuts the heel end and a forefoot portion abuts the forefoot end.

18. A method of forming a braided upper comprising:

braiding a tube structure using a braiding machine, the braiding machine comprising: a support structure with a plurality of rotor metals arranged in a track on the support structure, wherein at least one rotor metal in the plurality of rotor metals is selectively moveable, and wherein a forming mandrel is secured to the support structure; a ring, the ring being located in a plane, wherein a braiding point of the braiding machine is located in the plane, wherein a first portion of the forming mandrel is located within the ring, and wherein a second portion of the forming mandrel is located above the plane;

inserting a last into the tube structure; and conforming the tube structure to a shape of the last.

19. The method according to claim 18, further comprising forming a first seam within the tube structure.

20. The method according to claim 19, further comprising forming a second seam within the tube structure, wherein the first seam is spaced from the second seam.

21. The method according to claim 20, wherein the first seam within the tube structure corresponds to a heel edge and the second seam within the tube structure corresponds to a forefoot edge.

22. A braiding machine system comprising:

a support structure;

a plurality of rotor metals arranged along a track on the support structure;

a forming mandrel, a first portion of the forming mandrel extending through a braiding point;

a ring, the ring being located in a plane, wherein the braiding point is located in the plane and a second portion of the forming mandrel is located above the plane; and a securing portion securing the forming mandrel to the support structure of the braiding machine;

wherein at least one of the plurality of rotor metals is selectively movable.

23. The braiding machine system according to claim 22, wherein the plurality of rotor metals includes a first rotor metal and a second rotor metal, the first rotor metal being adjacent to the second rotor metal, wherein as the first rotor metal rotates the second rotor metal remains stationary.

24. The braiding machine system according to claim 22 wherein the forming mandrel is shaped as a forefoot portion.

25. The braiding machine system according to claim 24, wherein the forming mandrel has a first end and a second end, the first end extending through the braiding point and the second end oriented in the opposite direction from the first end.

26. The braiding machine system according to claim 25, wherein the first end is a toe edge and the second end is a forefoot end.

27. The braiding machine system according to claim 22, wherein the securing portion extends from below the braiding point to above the braiding point.

28. The braiding machine system according to claim 22, further comprising a plurality of carriages configured to accept spools.

* * * * *